US005192650A

United States Patent [19]

Seto et al.

[11] Patent Number: 5,192,650

[45] Date of Patent: Mar. 9, 1993

[54] SILVER HALIDE COLOR PHOTOGRAPHIC MATERIAL CONTAINING A COLOR IMAGE STABILIZER

[75] Inventors: Nobuo Seto; Masakazu Morigaki, both of Kanagawa, Japan

[73] Assignee: Fuji Photo Film Co., Ltd., Minami-ashigara, Japan

[21] Appl. No.: 644,839

[22] Filed: Jan. 23, 1991

[30] Foreign Application Priority Data

Jan. 25, 1990 [JP] Japan ..... 2-15792
Jul. 17, 1990 [JP] Japan ..... 2-188242

[51] Int. Cl.[5] ..... G03C 1/38; G03C 7/32; G03C 7/388; G03C 1/34

[52] U.S. Cl. ..... 430/546; 430/551; 430/552; 430/553; 430/554; 430/555; 430/556; 430/557; 430/558; 430/607; 430/608; 430/611; 430/613; 430/614; 430/631; 430/541

[58] Field of Search ..... 430/551, 607, 608, 610, 430/611, 613, 614, 546, 631, 558, 552, 553, 554, 555, 556, 557, 543, 541, 542

[56] References Cited

U.S. PATENT DOCUMENTS

| | | | |
|---|---|---|---|
| 3,445,235 | 5/1969 | Burt | 430/608 |
| 3,761,275 | 9/1973 | Bigelow | 430/599 |
| 4,297,441 | 10/1981 | Kaneko et al. | 430/613 |
| 4,540,657 | 9/1985 | Krishnamurthy | 430/546 |
| 4,865,942 | 9/1989 | Gottschalk et al. | 430/138 |

OTHER PUBLICATIONS

Abstract, Claim 1, J63/108074 May 12, 1988.

*Primary Examiner*—Lee C. Wright
*Attorney, Agent, or Firm*—Burns, Doane, Swecker & Mathis

[57] ABSTRACT

A silver halide color photographic material is disclosed, which comprises a support having thereon a photographic layer containing at least one compound represented by formula (I):

(I)

wherein each of $R_{01}$, $R_{02}$ and $R_{03}$, which may be the same or different, represents a hydrogen atom, an aliphatic group, an aromatic group or a heterocyclic group; $R_{01}$ and $R_{02}$, $R_{02}$ and $R_{03}$, and $R_{01}$ and $R_{03}$ may be combined with each other, provided that all of $R_{01}$, $R_{02}$ and $R_{03}$ are not hydrogen atoms at the same time; each of $X_{01}$, $X_{02}$ and $X_{03}$, which may be the same or different, represents a mere bond, —O—, —S— or and $R_{04}$ has the same meaning as $R_{01}$.

14 Claims, No Drawings

SILVER HALIDE COLOR PHOTOGRAPHIC MATERIAL CONTAINING A COLOR IMAGE STABILIZER

FIELD OF THE INVENTION

The present invention relates to a silver halide color photographic material, and more particularly, to a silver halide color photographic material in which color images finally obtained by processing are prevented from fading or discoloring.

BACKGROUND OF THE INVENTION

A silver halide color photographic material generally has silver halide emulsion layers sensitive to three elementary colors of red, green and blue, and color images are reproduced by the method of developing three types of color couplers contained in the respective emulsion layers so as to be complementary to the colors to which the respective layers are sensitive, the so-called subtractive color process. The color images obtained by photographic processing of the silver halide color photographic materials generally comprise azomethine dyes or indoaniline dyes formed by reaction of oxidation products of aromatic primary amine color developing agents with the couplers. The color photographic images thus obtained are not necessarily stable against light and wet heat. If they are exposed to light or stored under the circumstances of high temperature and humidity for long periods of time, the fading or discoloring thereof is produced, which results in deterioration of image qualities.

Such fading or discoloring of the images is a disadvantage which may be fatal to recording materials. As methods for removing this disadvantage have been made the various proposals of developing couplers having high fastness for the dyes obtained thereby, using antifading agents and using ultraviolet absorbers to prevent image deterioration due to ultraviolet rays.

Techniques for preventing image deterioration with antifading agents have been actively developed among others. For example, it is known to add hydroquinones, hindered phenols, catechols, gallates, aminophenols, hindered amines, chromanols, indanes, ethers or esters of these compounds whose phenolic hydroxyl groups are silylated, acylated or alkylated, metal complexes and salts of organic boron compounds (See JP-A-63-108074, the term "JP-A" as used herein means an "unexamined published Japanese patent application).

In recent years, increasing customers' demands for storage of images lead to requirements for recording materials having higher fastness. However, though these compounds surely show the antifading effect, they are insufficient to fulfill these requirements, and moreover, many of them adversely affect photographic characteristics. The salts of organic boron compounds described in JP-A-63-108074 not only are insufficient in image storing effect, but also tend to produce fog.

A technique for improving image fastness is therefore required which does not have adverse effects such as fog on photographic characteristics and does not produce yellow-stains (yellowing of unexposed portions).

SUMMARY OF THE INVENTION

Accordingly, an object of the present invention is to provide a silver halide color photographic material excellent in image fastness.

Another object of the present invention is to provide a silver halide color photographic material excellent in image fastness by a process which exerts no adverse effect on photographic characteristics.

As a result of various studies, the present inventors discovered that the above-described objects were attained by adding at least one compound represented by formula (I) to a photographic layer of a silver halide color photographic material:

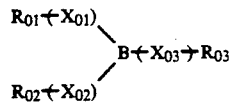

(I)

wherein each of $R_{01}$, $R_{02}$ and $R_{03}$, which may be the same or different, represents a hydrogen atom, an aliphatic group, an aromatic group or a heterocyclic group; $R_{01}$, and $R_{02}$, $R_{02}$ and $R_{03}$, and $R_{01}$ and $R_{03}$ may be combined with each other, provided that all of $R_{01}$, $R_{02}$ and $R_{03}$ are not hydrogen atoms at the same time: each of $X_{01}$, $X_{02}$ and $X_{03}$ which may be the same or different, represents a mere bond —)—, —S— or

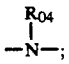

and $R_{04}$ has the same meaning as $R_{01}$.

DETAILED DESCRIPTION OF THE INVENTION

The aliphatic groups represented by $R_{01}$, $R_{02}$ and $R_{03}$ in the present invention include alkyl groups, alkenyl groups, alkynyl groups, cycloalkyl groups, cycloalkenyl groups, cycloalkynyl groups and aralkyl groups, which may be branched and further substituted. The total carbon atoms of the aliphatic groups are from 1 to 60. Examples of the substituents include acyl groups, acyloxy groups, acylthio groups, acylamino groups, alkoxy groups, alkoxycarbonyl groups, aryloxy groups, aryloxycarbonyl groups, alkoxycarbonylamino groups, aryloxycarbonylamino groups, alkoxyamino groups, aryloxyamino groups, alkoxyaminocarbonyl groups, aryloxyaminocarbonyl groups, alkyloxysulfonamide groups, aryloxysulfonamide groups, alkyloxysulfamoyl groups, aryloxysulfamoyl groups, alkylsulfonyl groups, arylsulfonyl groups, alkylsulfinyl groups, arylsulfinyl groups, alkylsulfonamide groups, arylsulfonamide groups, alkylsulfamoyl groups, arylsulfamoyl groups, alkylcarbamoyl groups, arylcarbamoyl groups, alkylthio groups, arylthio groups, alkylamino groups, dialkylamino groups, arylamino groups, diarylamino groups, hydroxyl groups, halogen atoms, cyano groups, alkylureide groups, arylureide groups, mercapto groups and aryl groups. Examples of such aliphatic groups include methyl, ethyl, t-butyl, t-pentyl, t-octyl, dodecyl, allyl, benzyl, methoxyethyl, cyclohexyl and 2-ethylhexyl. The aromatic groups represented by $R_{01}$, $R_{02}$ and $R_{03}$ in the present invention include carbocyclic aromatic groups Which may be monocyclic or condensed-cyclic and further substituted. The total carbon atoms of the aromatic groups are from 6 to 60. Examples of the substituents include alkyl groups and the same substituents as those for the above aliphatic groups. Examples of such aromatic groups include phenyl, naphthyl, p-methoxyphenyl, furyl, thienyl and benzofuryl. The heterocyclic groups represented by $R_{01}$, $R_{02}$ and $R_{03}$ in the present invention include groups Of 3- to 10-membered rings formed by oxygen atoms, nitrogen atoms and/or sulfur atoms, which may be saturated rings or unsaturated rings and further substituted. Examples of the substituents include alkyl groups and the same substituents as those for the above aliphatic groups. Examples of such heterocyclic groups include 2-piperidyl, 4-morpholinyl, 3-morpholinyl and 3-pyrrolinyl. All of $R_{01}$, $R_{02}$ and $R_{03}$ are not hydrogen atoms at the same time.

$R_{01}$, $R_{02}$ and $R_{03}$ may be the same or different. $R_{01}$ and $R_{02}$, $R_{02}$ and $R_{03}$, and $R_{01}$ and $R_{03}$ may be combined with each other. Each of $X_{01}$, $X_{02}$ and $X_{03}$ represents a mere bond, —O—, —S— or

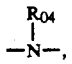

which may be the same or different. The mere bond means that B is directly combined with $R_{01}$, $R_{02}$ or $R_{03}$ without intervention of $X_{01}$, $X_{02}$ or $X_{03}$ $R_{04}$ has the same meaning as $R_{01}$.

Of the compounds represented by the above-described general formula (I), compounds in which at least one (more preferably, at least two, and most preferably, all) of $X_{01}$, $X_{02}$ and $X_{03}$ is —O—, —S— or

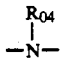

are preferable because of their stability to oxygen or water. Furthermore, compounds in which at least one more preferably, two) of $X_{01}$, $X_{02}$ and $X_{03}$ is —O— are preferable in respect to the effects of the present invention.

Compounds in which $R_{01}$, $R_{02}$ or $R_{03}$ is a substituent group bulky in three dimensions are preferable because of their higher stability to water and also in respect to the effects of the present invention. The substituent groups bulky in three dimensions include branched aliphatic groups (for example, tert-butyl, tert-octyl, sec-butyl and cyclohexyl) and aromatic or heterocyclic groups having substituent groups at the ortho-positions [more preferably, aromatic or heterocyclic groups having substituent groups bulky in three dimensions (for example, tertbutyl and cyclohexyl) at the ortho-positions].

When at least one of $R_{01}$ $R_{02}$ and $R_{03}$ is a coupler residue, the compound of the present invention acts as a coupler.

When the compounds of the present invention are couplers, any of the couplers may be used as long as it reacts with an oxidation product of an aromatic primary amine color developing agent to form a yellow dye, a magenta dye or a cyan dye.

Four equivalent couplers or 2 equivalent couplers of cyan couplers, magenta couplers or yellow couplers may be used as the compounds having the coupler residual groups. The coupler residual groups may be combined with a skeleton of these couplers, or with releasing group portions or oil-solubilizing group portions.

When the coupler residual groups are yellow coupler residues, pivaloylacetanilide couplers, benzoylacetanilide couplers and indazolone couplers are preferably used as the yellow couplers. When the coupler residual groups are magenta coupler residues, 5-pyrazolone couplers, pyrazolobenzimidazole couplers and pyrazoloazole couplers are preferably used as the magenta couplers. When the coupler residual groups are cyan coupler residues, 2-acylaminophenol couplers, 2,5-diacylamino couplers and azole couplers are preferably used as the cyan couplers, and particularly couplers represented by formulae (C-I), (C-II), (M-I), (M-II) and (Y) as described hereinafter are preferred.

When the compounds of the present invention are used as the couplers, color image stabilizers (antifading agents) or high boiling solvents, compounds represented by the following formulae (I-1) and I-2) are preferred.

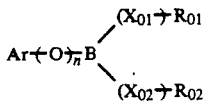

(I-1)

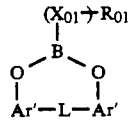

(I-2)

wherein Ar represents a monovalent aromatic group; Ar′ represents divalent aromatic group; L represents a mere bond or a divalent organic group; n represents 0 or 1; and $X_{01}$, $X_{02}$, $R_{01}$ and $R_{02}$ have the same meanings as given in the formula (I).

The monovalent aromatic group represented by Ar is preferably an aryl group having 6 to 20 carbon atoms, and more preferably a phenyl group. The divalent aromatic group represented by Ar′ is preferably an arylene group having 6 to 20 carbon atoms, and more preferably a phenylene group. These aromatic groups may have substituent groups (for example, chlorine, alkyl, aryl, alkoxy and aryloxy).

Preferably, $R_{01}$ and $R_{02}$ each represents substituted or unsubstituted alkyl group, substituted or unsubstituted phenyl group, and substituted or unsubstituted and unsaturated heterocyclic group containing a nitrogen atom as a hetero atom.

The organic groups represented by L include alkylene groups having 1 to 10 carbon atoms (preferably 1 to 6 carbon atoms), phenylene groups, —O—, —S—, and combined groups thereof. In particular, an alkylene group substituted by an alkyl group is preferred.

Specific examples of the compounds of the present invention are hereinafter illustrated. However, the scope of the present invention is not limited thereto.

IY-1
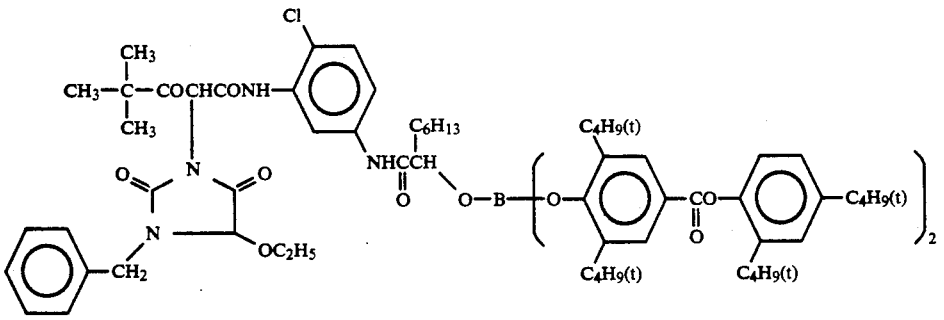
IY-2
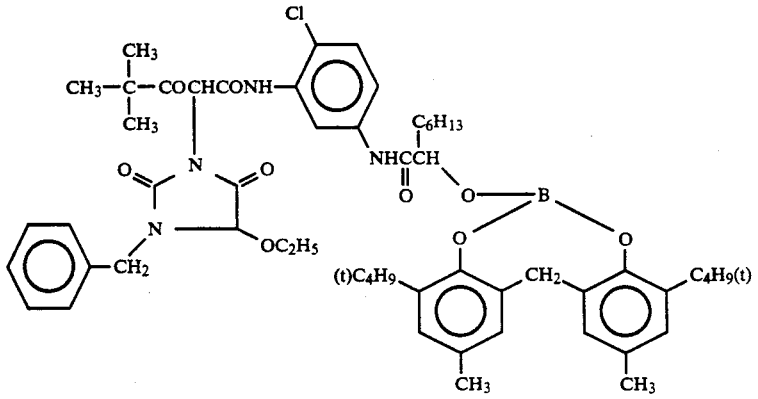
IY-3
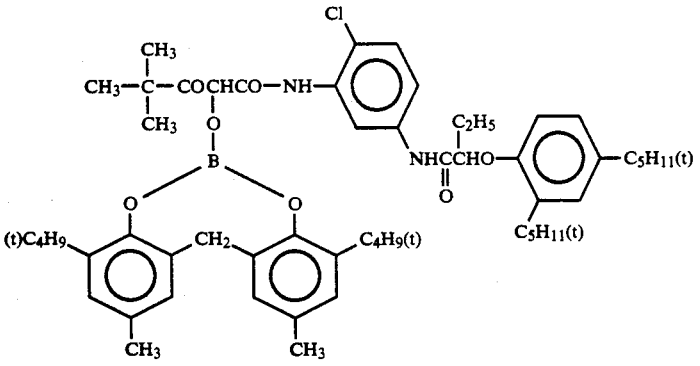
IY-4
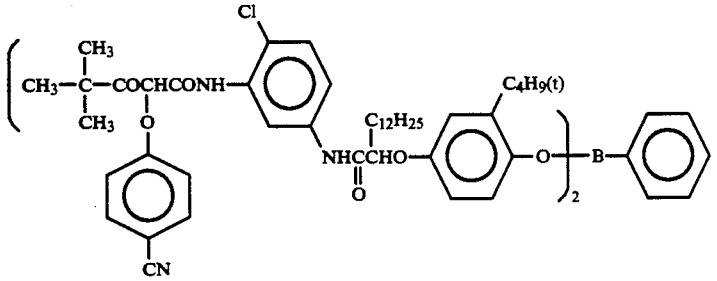

-continued
IY-5
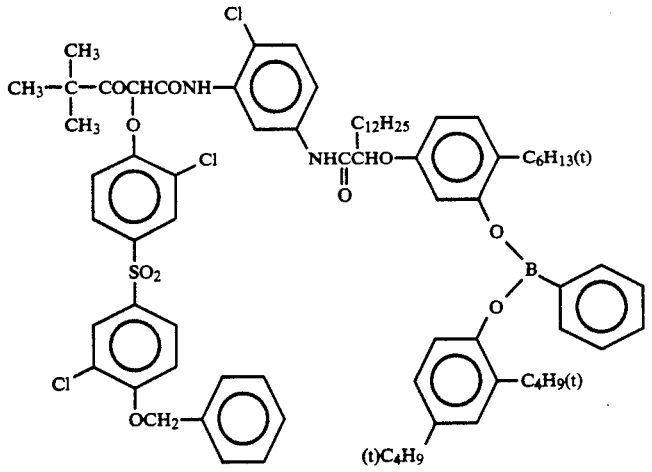
IY-6
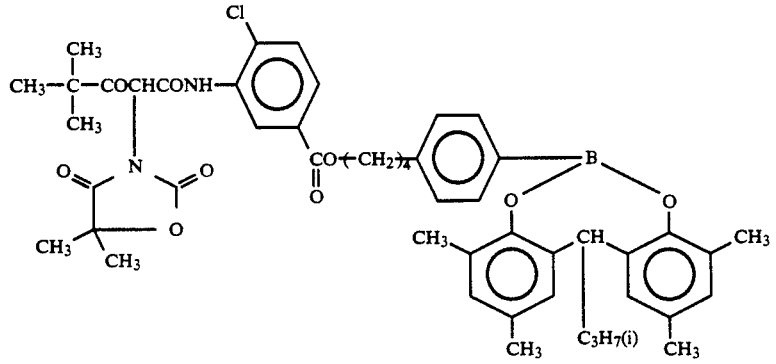
IM-7
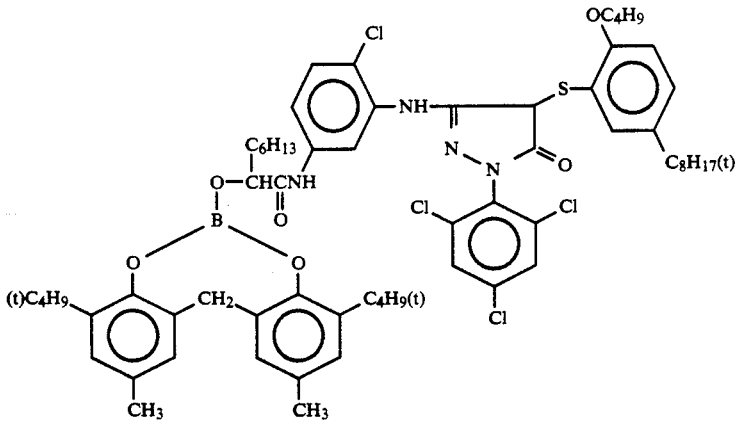
IM-8
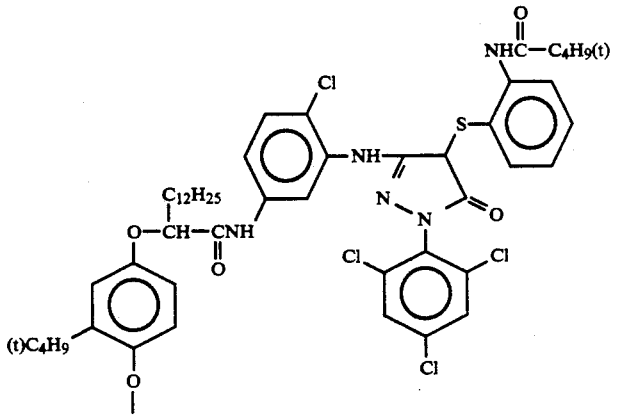

-continued
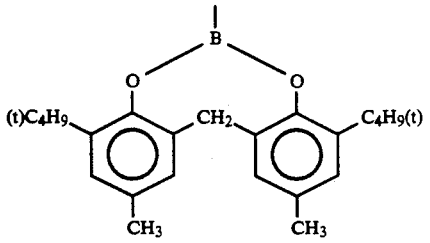
IM-9
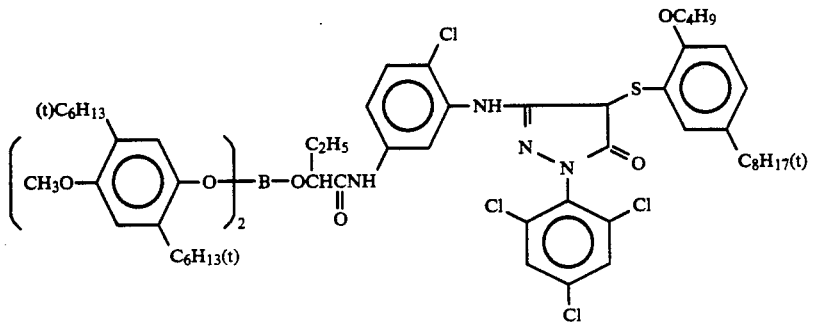
IM-10
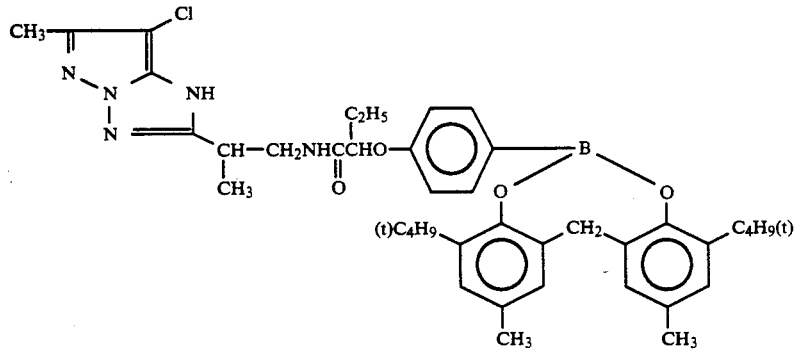
IM-11
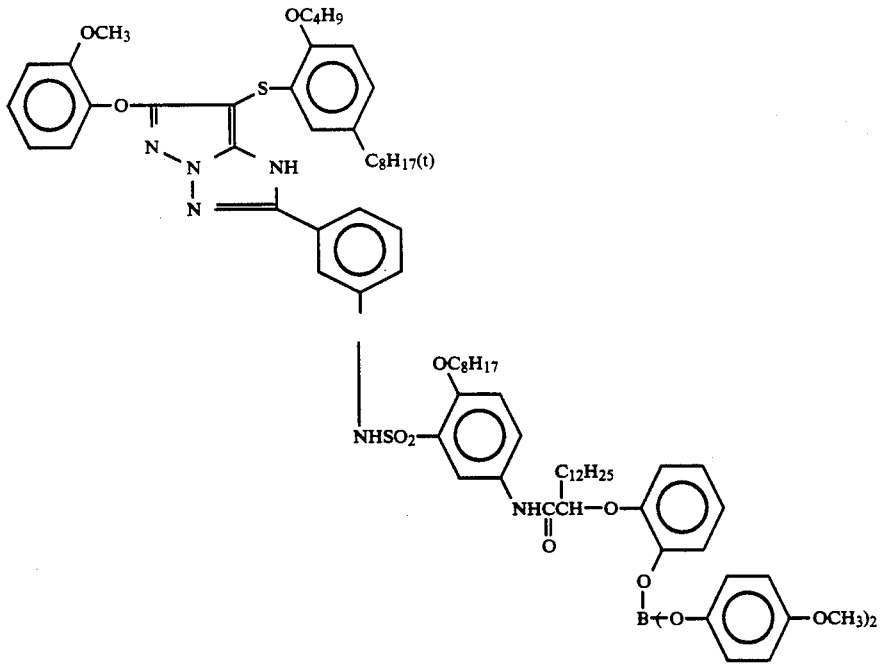

-continued
IM-12
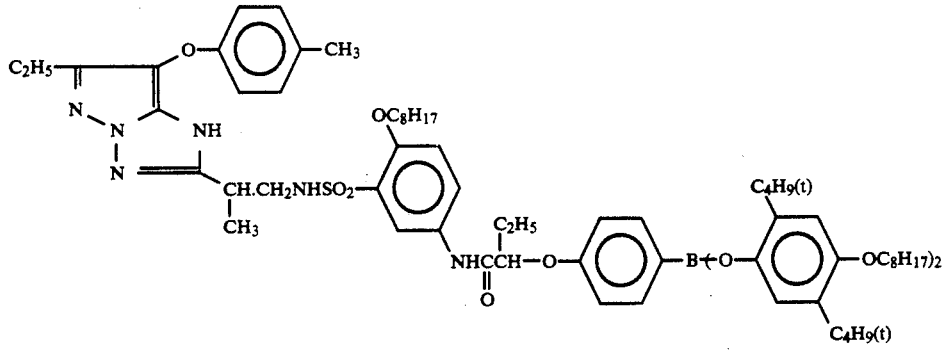
IM-13
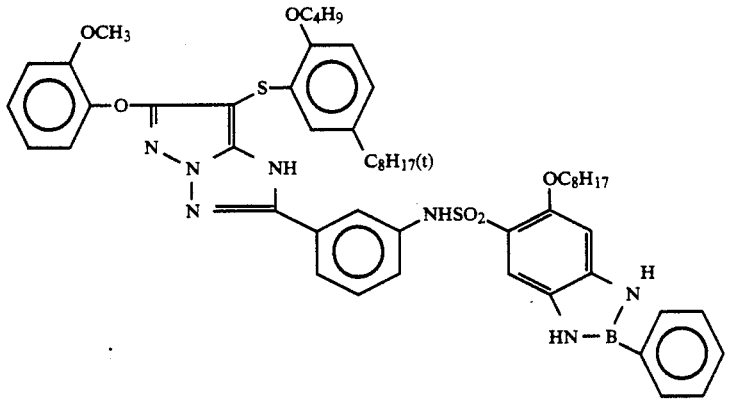
IM-14
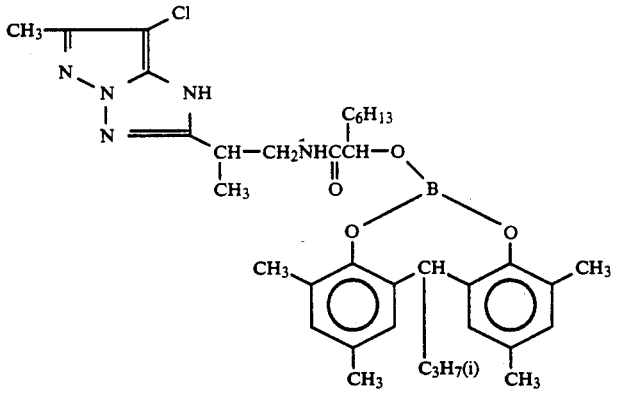
IM-15
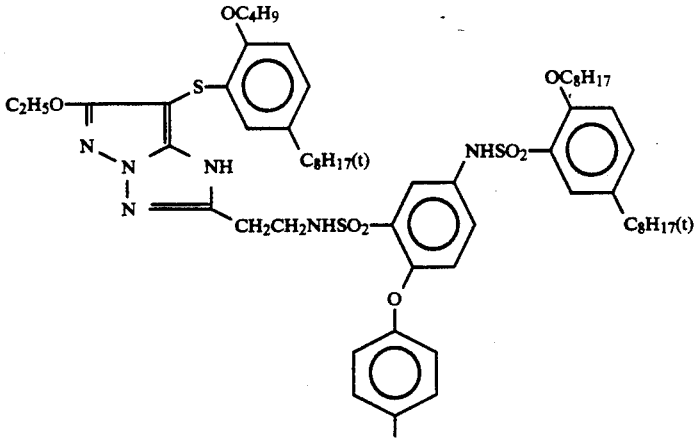

-continued
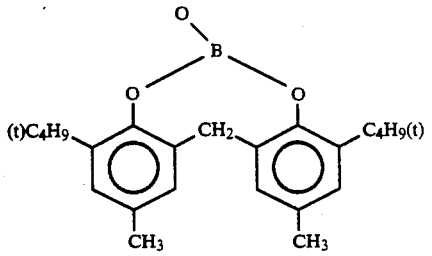
IC-16
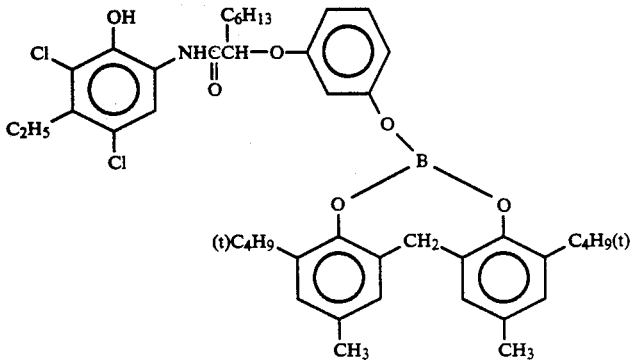
IC-17
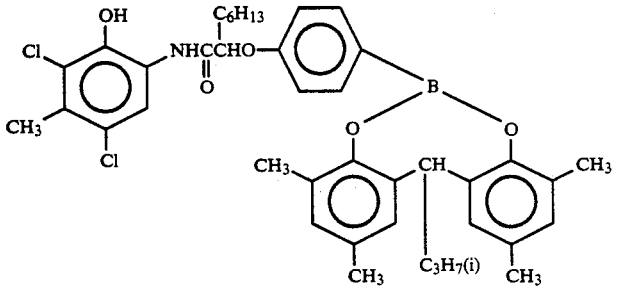
IC-18
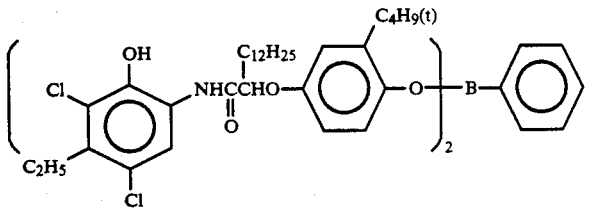
IC-19
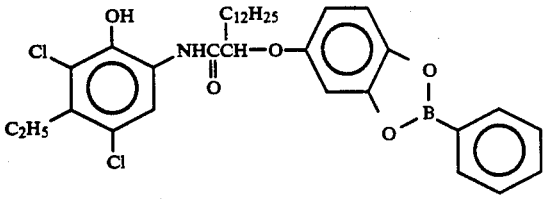
IC-20
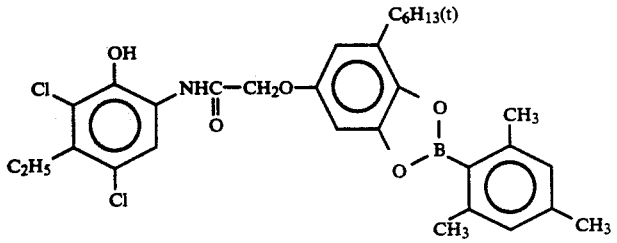

-continued
IC-21
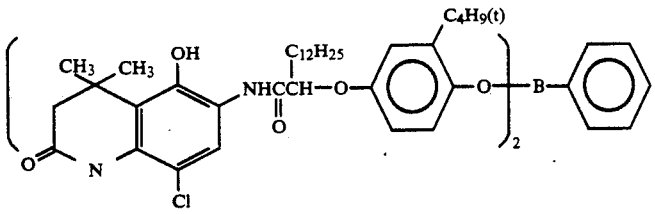
IY-22
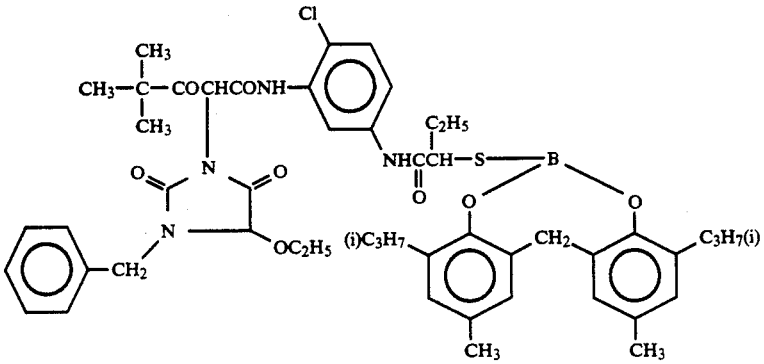
IY-23
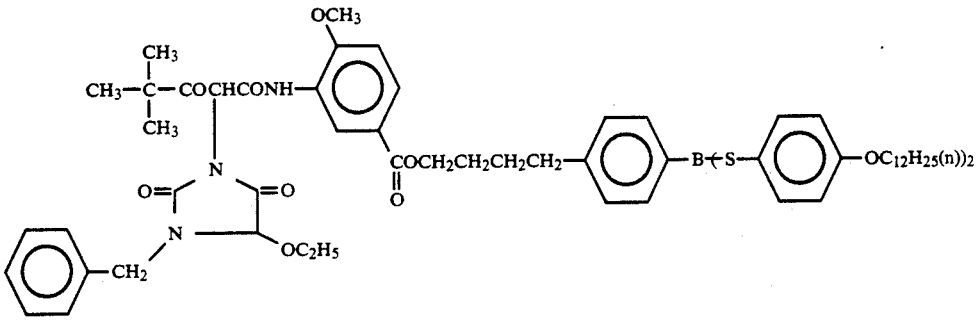
IM-24
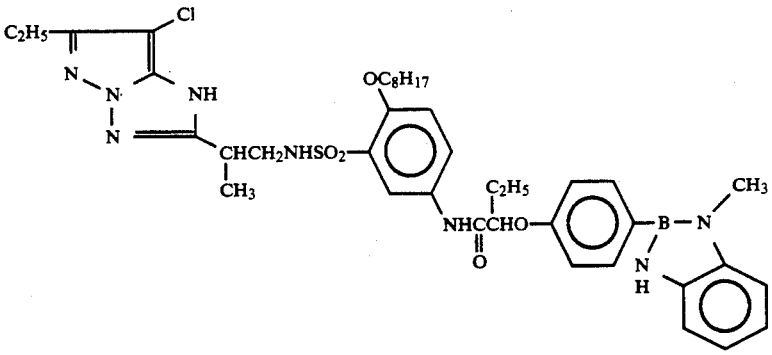
IM-25
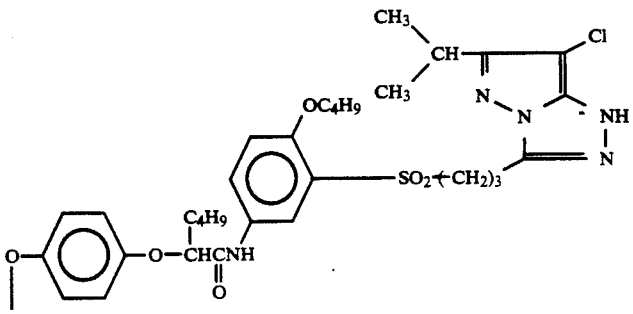

-continued
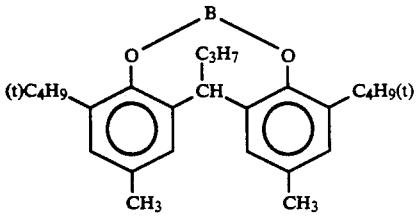
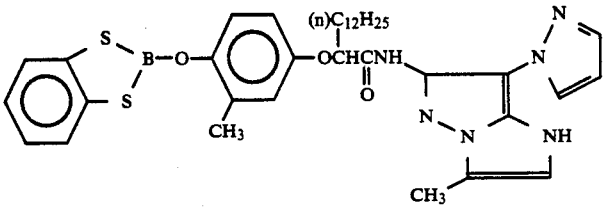
IM-26
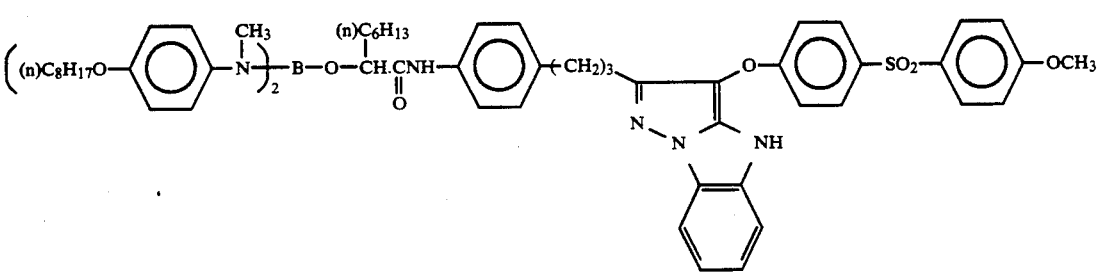
IM-27
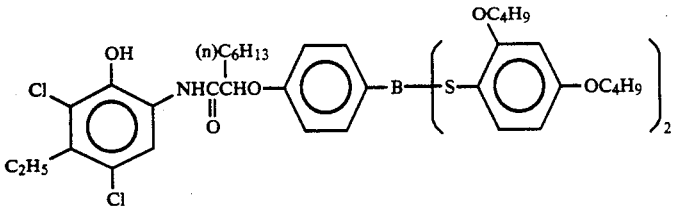
IC-28
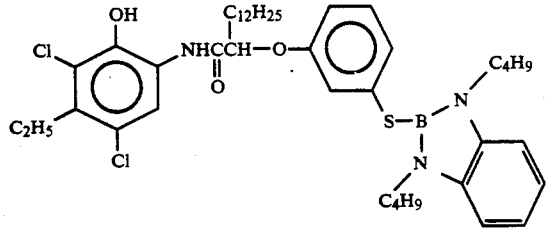
IC-29
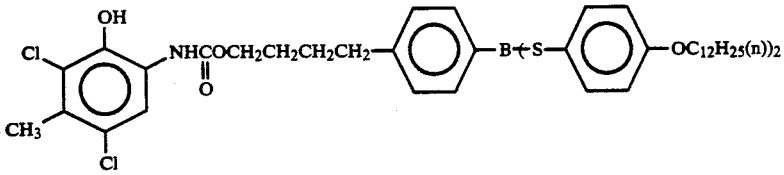
IC-30
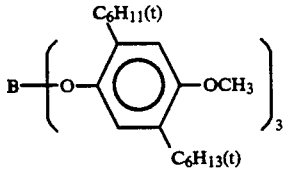
IA-1
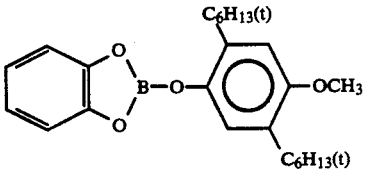
IA-2
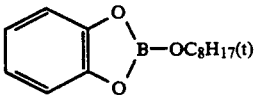
IA-3
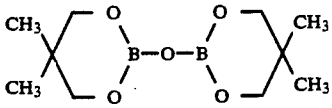
IA-4

-continued
IA-5
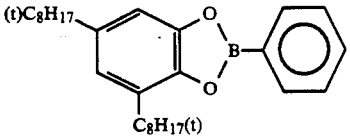
IA-6
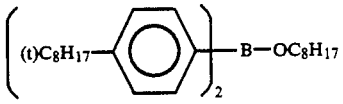
IA-7
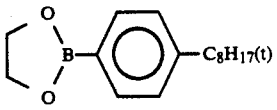
IA-8
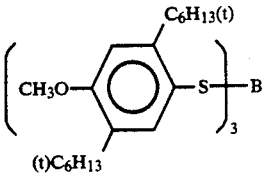
IA-9
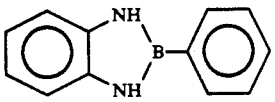
IA-10
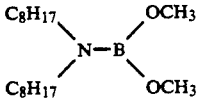
IA-11
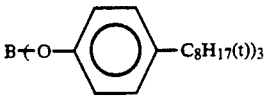
IA-12
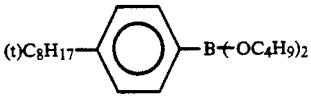
IA-13
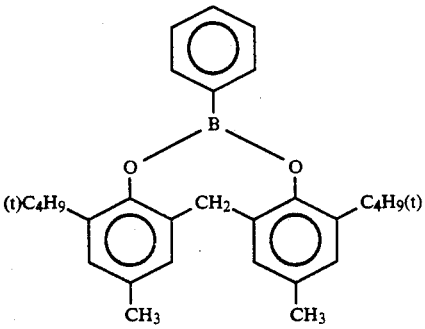
IA-14
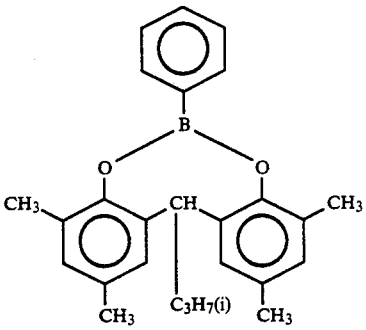
IA-15
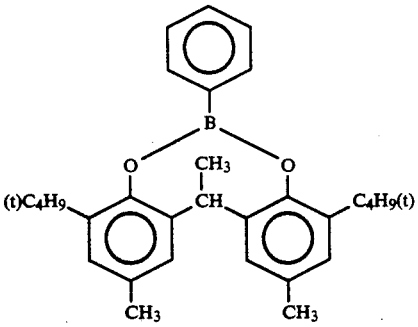
IA-16
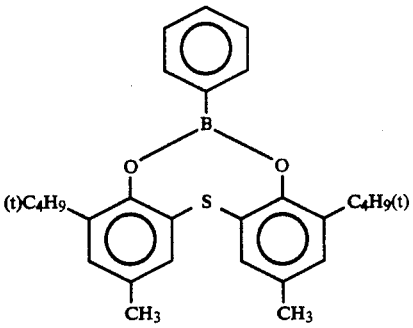
IA-17
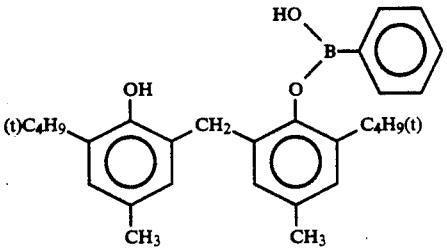
IA-18
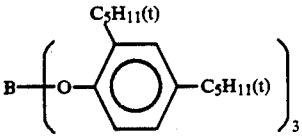

-continued
IA-19
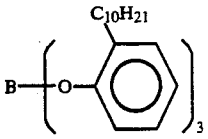
IA-20
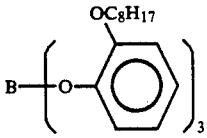
IA-21
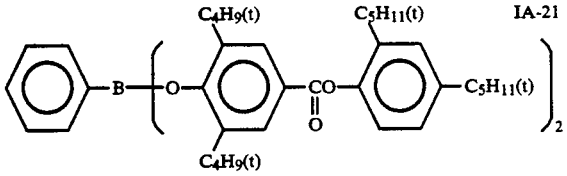
IA-22
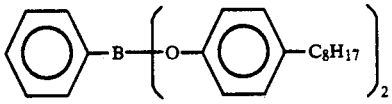
IA-23
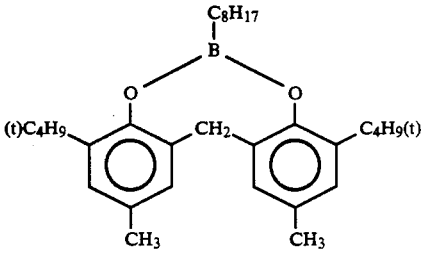
IA-24
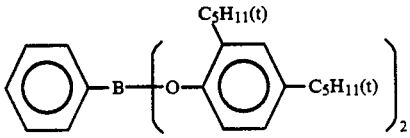
IA-25
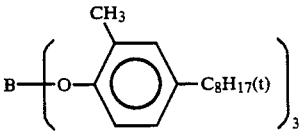
IA-26
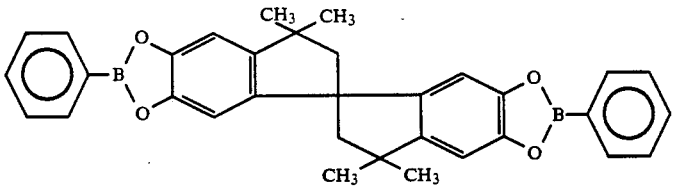
IA-27
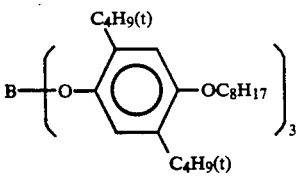
IA-28
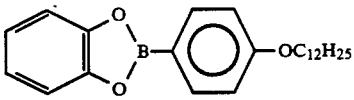
IA-29
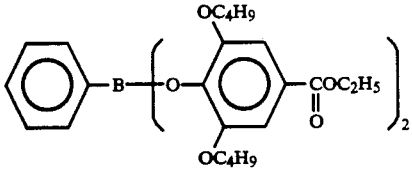
IA-30
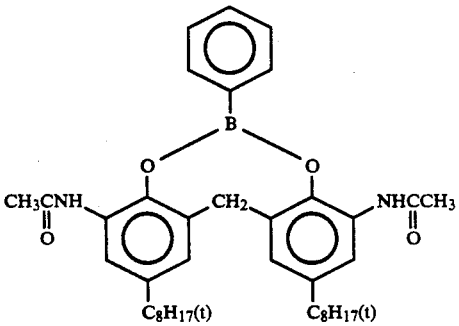

-continued
IA-31
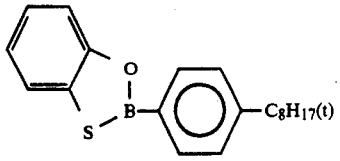
IA-32
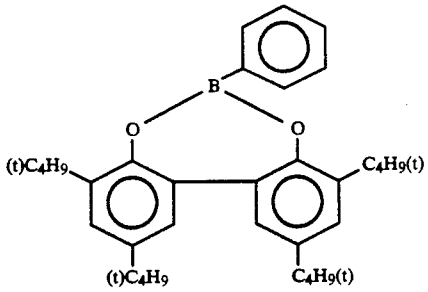
IA-33
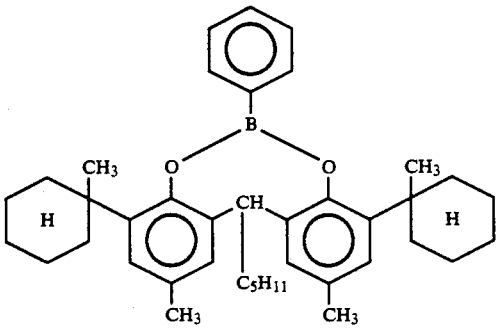
IA-34
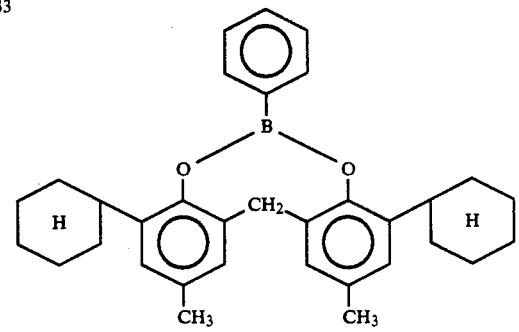
IA-35
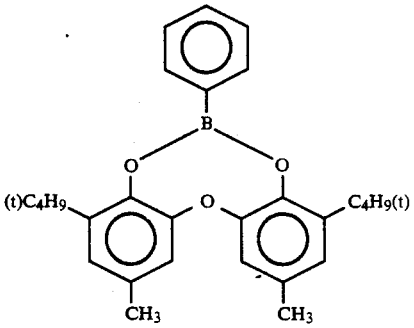
IA-36
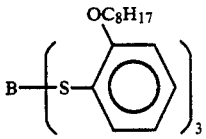
IA-37
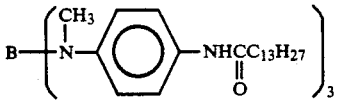
IA-38
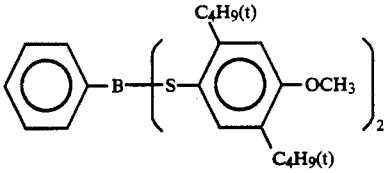
IA-39
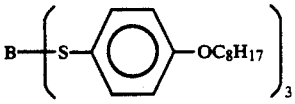
IA-40
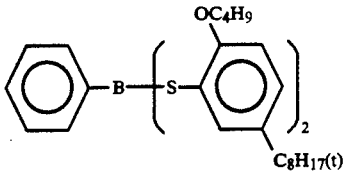
IA-41
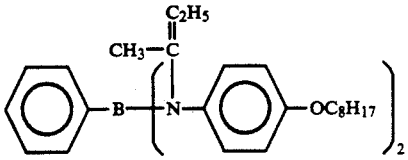
IA-42
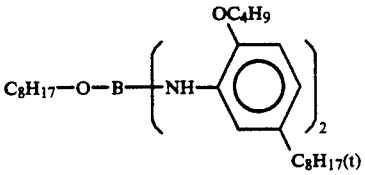

-continued
IA-43
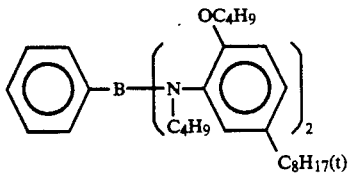
IA-44
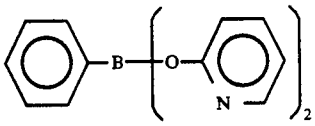
IA-45
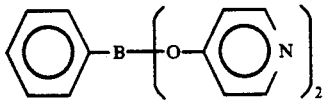
IO-1
$B(OC_6H_{13})_3$
IO-2
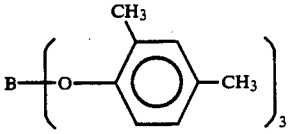
IO-3
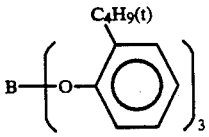
IO-4
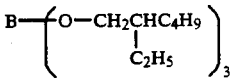
IO-5
$B(O-C_{12}H_{25})_3$
IO-6
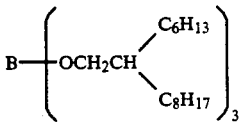
IO-7
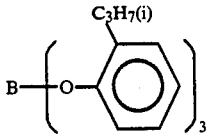
IO-8
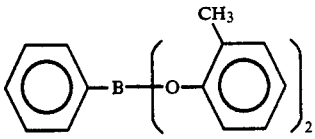
IO-9
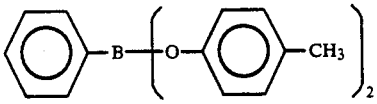
IO-10
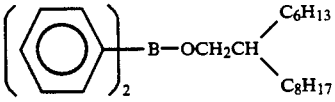
IO-11
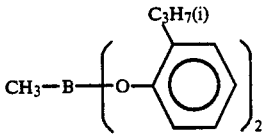
IO-12
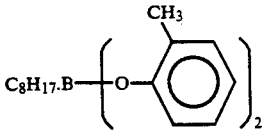
IO-13
$C_4H_9CH(C_2H_5)CH_2-B(OC_4H_9(t))_2$
IO-14
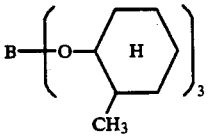
IO-15
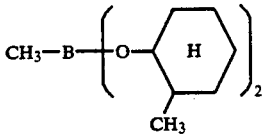
IO-16
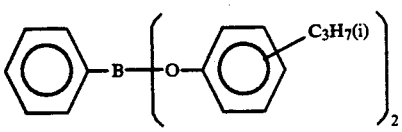
IO-17
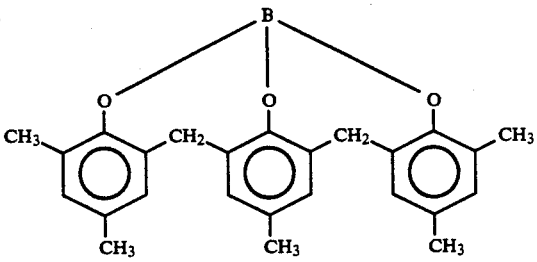

-continued $B\leftarrow SC_8H_{17})_3$ IO-18

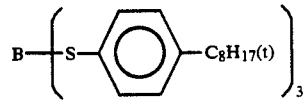
IO-19

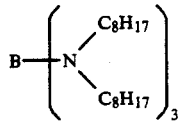
IO-20

$B\leftarrow NHC_{12}H_{25})_3$ IO-21

$B\leftarrow O-CH_2CH_2-O-CH_2CH_2-O-C_2H_5)_3$ IO-22

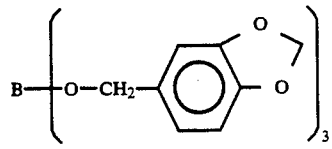
IO-23

$B\leftarrow OCH_2CH_2SO_2C_8H_{17})_3$ IO-24

The compounds of the present invention can be synthesized by or in accordance with the methods described in *New Lectures on Experimental Chemistry*, Vol. 12, pages 287 to 307 (1976), Maruzen and J. Chem. Soc. (C), 488–493, (1970).

When the compounds of the present invention are the couplers, they can be synthesized by or in accordance with combinations of the methods described in JP-B-51-10783 (the term "JP-B" as used herein means an "examined Japanese patent publication"), JP-B-51-33410, JP-B-48-27930, JP-B-52-33846, JP-A-59-171956 and U.S. Pat. No. 2,369,929 and the methods described in *New Lectures on Experimental Chemistry*, Vol. 12, pages 287 to 307 (1976), Maruzen and *J. Chem. Soc.* (C), 488–493, (1970)

Specific synthesis examples of the compounds of the present invention are hereinafter described.

Synthesis of Trihexyl Borate (Compound IO-1)

Concentrated sulfuric acid (1.5 ml, 0.027 mol) was added dropwise to boric acid (6 g, 0.098 mol), hexyl alcohol (50 g, 0.490 mol) and toluene (150 ml) which were heated under reflux. Reaction was further continued for 7 hours by removing water as the toluene azeotrope. Then, toluene was removed by distillation under reduced pressure, and subsequently, distillation was conducted under reduced pressure to obtain 14 g of a distillate having a boiling point of 130° to 135° C./18 mmHg. The resulting oily product was confirmed to be trihexyl borate by the mass spectrum and the NMR spectrum. The yield was 45.6%.

Reaction is conducted in the same manner as described above except that phenylboric acid or methylboric acid is used instead of boric acid in the above example and a corresponding alcohol or phenol is used instead of hexyl alcohol, and then, the solvent is concentrated under reduced pressure, followed by distillation or crystallization and recrystallization with an appropriate solvent, whereby a corresponding boron compound can be obtained.

Various routes can be considered to synthesize couplers having boron incorporated in their molecules. Namely, boron-containing portions may be combined with couplers containing no boron in their molecules, or couplers may be synthesized by conventional synthesis methods using boron-containing compounds synthesized by the above-described method or the like.

A specific synthesis example for incorporating a boron-containing portion in a coupler is hereinafter illustrated.

Synthesis of Coupler IY-3

Boron was incorporated in this coupler by the following route:

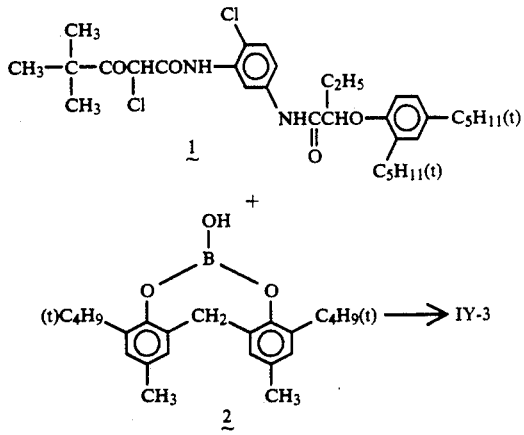

Compound 1 was synthesized by the conventional method for synthesizing couplers (described in the above literatures).

(1) Synthesis of Compound 2

Concentrated sulfuric acid (0.5 ml, 0.009 mol) was added dropwise to boric acid (10 g, 0.164 mol), 2,2-methylenebis (6-tert-butyl-p-cresol) (17 g, 0.05 mol) and toluene (150 ml) which were heated under reflux. Reaction was further continued for 4 hours by removing water as the toluene azeotrope. Then, toluene was removed by distillation under reduced pressure, followed by separation by column chromatography. The solvent was concentrated to dryness to obtain 8.3 g of a powder. The yield was 45.5%.

(2) Synthesis of IY-3

Compound 2 (3.7 g, 0.010 mol) was dissolved in 15 ml of dimethylacetamide, and sodium hydride (0.4 g, 0.010 mol) was slowly added thereto with stirring at 22° to 25° C. On the other hand, compound 1 (5.7 g, 0.0094 mol) was dissolved in tetrahydrofuran (6 ml), and the resulting solution was added dropwise to the above-described solution of compound 2 at 22° to 25° C. for 10 minutes with stirring. After further stirring at 22° to 25° C. for 3 hours, the mixture was poured on ice-cold water (50 ml) containing acetic acid (0.5 ml), followed by extraction with ethyl acetate (50 ml). The extract was washed 3 times with brine and dried with magnesium sulfate. After removing magnesium sulfate by filtration, the extract was concentrated to dryness under reduced pressure, followed by separation by silica gel column chromatography and crystallization with acetonitrile/methanol/ethyl acetate (10/10/1). Thus, 3.8 g of a crystal product having a melting point of 67° to 76° C. was obtained. This crystal product was confirmed to be exemplified coupler IY-3 by the mass spectrum and the NMR spectrum. The yield was 40.0%.

When the compounds of the present invention are the couplers, the compounds are preferably contained in silver halide emulsion layers constituting light-sensitive layers in an amount of generally 0.1 to 1.0 mol, more preferably 0.1 to 0.5 mol per mol of silver halide.

The compounds of the present invention are used as the antifading agents or the high boiling point organic solvents, the compounds are preferably added in an amount of 1 to 400% by weight, more preferably 5 to 200% by weight based on the weight of the couplers.

When the compounds of the present invention are the couplers, the couplers may be used alone, or two or more kinds of them may be used in combination with one another, or they may be used in combination with known couplers.

When the compounds of the present invention are the antifading agents or the high boiling point organic agents, they may be used alone, or two or more kinds of them may be used in combination with one another, or they may be used in combination with known antifading agents or high boiling point organic solvents.

A general color photographic material can be formed by applying at least one layer for each of blue-sensitive, green-sensitive and red-sensitive silver halide emulsion layers on a support in this order, but they may be applied in a different order. Further, an infrared-sensitive silver halide emulsion layer can be used in place of at least one of the above-described emulsion layers. Each of these light-sensitive emulsion layers contains a silver halide emulsion having sensitivity to each wavelength region and a dye complementary to light to which the emulsion layer is sensitive, namely a so-called color coupler forming yellow to blue, magenta to green or cyan to red, and thereby color reproduction can be achieved according to a subtractive color process. However, the light-sensitive emulsion layers and the formed colors may be combined so as not to have the correspondence described above.

The compounds of the present invention can be applied, for example, to color paper, color reversal paper, direct positive photographic materials, color negative film, color positive film, color reversal film and the like. They are preferably applied to color photographic materials having reflecting supports such as color paper and color reverse paper and color photographic materials for forming positive images such as direct positive color photographic materials, color positive film and color reverse film, among others, and particularly, the application to the color photographic materials having the reflecting supports is preferred.

Silver halides having any halogen composition such as silver iodobromide, silver iodochlorobromide, silver bromide, silver chlorobromide and silver chloride may be used for the silver halide emulsions used in the present invention.

Grains contained in the emulsion may be the same or different from one another in halogen composition. However, when the emulsion containing the grains each of which has the same halogen composition is used, it is easy to homogenize the properties of each grain. With respect to the internal halogen composition distribution of the silver halide grains, there can be suitably selected to use the grains of a so-called uniform type structure in which the composition is the same at any portion of the grain, grains of a so-called laminated type structure in which an internal core of the grain is different from a shell (one layer or a plurality of layers) surrounding it in halogen composition, or the grains of a structure in which the inside of the grain or the surface thereof has non-layer portions different in halogen composition (a structure in which the portions different in halogen composition are connected to the edges, the corners or the surface of the grain when they are on the surface of the grain). In order to obtain high sensitivity, it is more advantageous to use either of the latter two grains than to use the grains of the uniform type structure. The latter two grains are preferable also in respect to restraint of generation of stress marks. When the silver halide grains have the structure as described above, a boundary between portions different from each other in halogen composition may be clear or unclear due to formation of mixed crystals by the difference in composition. Further, continuous changes in structure may be positively given thereto.

The preferred halogen composition varies depending on the type of photographic material to which the silver halide emulsion is applied. The silver chlorobromide emulsions are mainly used for color paper. The silver iodobromide emulsions are used for photographic materials for picture taking such as color negative film, and the silver bromide or silver chlorobromide emulsions are used for direct positive color photographic materials. Further, so-called high silver chloride emulsions having a high silver chloride content are preferably used for photographic materials for color paper suitable for rapid processing. The silver chloride content of these high silver chloride emulsions is preferably at least 90 mol%, and more preferably at least 95 mol%.

In such high silver chloride emulsions, the grains of a structure in which the inside and/or the surface of the silver halide grain has silver bromide-localized phases in a layer form or in a non-layer form are preferred. The halogen composition of the above-described localized phases is preferably at least 10 mol%, and more preferably above 20 mol% in silver bromide content. These localized phases can exist inside the grain and on the edges, the corners and the surface of the grain. As one preferred example, there can be mentioned localized phases formed on the corner portions of the grain by epitaxial growth.

In the present invention, it is particularly preferred that emulsions comprising silver chlorobromide or silver chloride substantially free from silver iodide are used. Here, "substantially free from silver iodide" means that the content of silver iodide is 1 mol% or less, and preferably 0.2 mol% or less.

It is preferred that the silver halide grains contained in the silver halide emulsions used in the present invention have a mean grain size of 0.1 to 2 μm, and preferably 0.15 to 1.5 μm. The mean grain size is a number mean value of grain sizes represented by the diameters of circles equivalent to the projected areas of grains. Further, it is preferred that these emulsions are so-called monodisperse emulsions having a grain size distribution, namely a coefficient of variation (the standard deviation of the grain size distribution divided by the mean grain size) of generally not more than 20%, and preferably not more than 15%. At this time, for the purpose of obtaining a wide latitude, it is preferred that the above-described monodisperse emulsion can be blended in the same layer or can be coated in multiple layers.

The silver halide grains contained in the emulsions may have a regular crystal form such as a cubic, an octahedral or a tetradecahedral, or an irregular crystal form such as a spherical form or a plate form, or a composite form thereof. Further, tabular grains may be used.

The silver halide emulsions used in the present invention may be a so-called surface latent image type emulsion in which a latent image is mainly formed on the surfaces of the grains, or a so-called internal latent image type emulsion in which a latent image is mainly formed in the interior of the grains.

The silver halide emulsions which can be used in the present invention can be prepared, for example, according to the methods described in *Research Disclosure* (RD), No. 17643, pages 22 and 23, "I. Emulsion Preparation and Types" (December, 1978), ibid., No. 18716, page 648 (November, 1979), P. Glafkides, *Chimie et Phisique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964).

The monodisperse emulsions described in U.S. Pat. Nos. 3,574,628 and 3,655,394 and British Patent 1,413,748 are also preferably used. Further, tabular grains having an aspect ratio of 5 or more can also be used in the present invention. The tabular grains can be easily prepared by the methods described in Gutoff, *Photographic Science and Engineering*, Vol. 14, pages 248 to 257 (1970), U.S. Pat. Nos. 4,434,226, 4,414,310, 4,433,048 and 4,439,520 and British Patent 2,112,157.

The crystal structure may be uniform, or the interior of the grain may be different from the surface thereof in halogen composition. The crystal structure may also be a laminar structure. Silver halide grains having different compositions may be joined together by epitaxial bonding. Further, silver halide grains may be joined to compounds other than silver halides such as silver rhodanide and lead oxide.

Furthermore, mixtures of grains having various crystal forms may also be used.

The silver halide emulsions used in the present invention are generally subjected to physical ripening, chemical ripening and spectral sensitization.

In the course of formation of grain emulsions or physical ripening, various multivalent metal ion impurities can be introduced in the silver halide emulsions used in the present invention. Examples of compounds used include salts of cadmium, zinc, lead, copper and thallium, salts of the Group VIII metals of the Periodic Table, such as iron, ruthenium, rhodium, palladium, osmium, iridium and platinum, and complex salts thereof.

Additives used in physical ripening, chemical ripening and spectral sensitization stages of the silver halide emulsions used in the present invention are described in *Research Disclosure*, No. 17643, ibid., No. 18716 and ibid., No. 307105, and are summarized in the following table. Other conventional photographic additives which can be used in the present invention are also described in the above three *Research Disclosure* references, and are shown in the following table.

| Type of Additives | RD17643 | RD18716 |
|---|---|---|
| 1. Chemical Sensitizers | p.23 | p.648, right column |
| 2. Sensitivity Increasing Agents | — | " |
| 3. Spectral Sensitizers, Supersensitizers | p.23–24 | p.648, right column to p.649, right column |
| 4. Brightening Agents | p.24 | p.647 |
| 5. Antifoggants and Stabilizers | p.24–25 | p.649, right column |
| 6. Light Absorbers, Filter dyes, UV Absorbers | p.25–26 | p.649, right column to p.650, left column |
| 7. Stain Inhibitors | p.25, right column | p.650, left to right columns |
| 8. Dye Image Stabilizers | p.25 | p.650, left column |
| 9. Hardeners | p.26 | p.651, left column |
| 10. Binders | p.26 | " |
| 11. Plasticizers, Lubricants | p.27 | p.650, right column |
| 12. Coating Aids, Surfactants | p.26–27 | " |
| 13. Antistatic Agents | p.27 | " |
| 14. Mat Finishing Agents | — | — |

| Type of Additives | RD317015 |
|---|---|
| 1. Chemical Sensitizers | p.866 |
| 2. Sensitivity Increasing Agents | — |
| 3. Spectral Sensitizers, Supersensitizers | p.866–868 |
| 4. Brightening Agents | p.868 |
| 5. Antifoggants and Stabilizers | p.868–870 |
| 6. Light Absorbers, Filter dyes, UV Absorbers | p.873 |
| 7. Stain Inhibitors | p.872 |
| 8. Dye Image Stabilizers | p.872 |
| 9. Hardeners | p.874–875 |
| 10. Binders | p.873–874 |
| 11. Plasticizers, Lubricants | p.876 |
| 12. Coating Aids, Surfactants | p.875–876 |
| 13. Antistatic Agents | p.876–877 |
| 14. Mat Finishing Agents | p.878–879 |

In order to prevent deterioration in photographic properties due to formaldehyde gas, the compounds which can react with formaldehyde to fix it, described in U.S. Pat. Nos. 4,411,987 and 4,435,503, can also be added to the photographic materials.

When the photographic materials of the present invention are color photographic materials, various color couplers may be used in combination. Specific examples thereof are described in the patents cited in *Research Disclosure (RD)*, No. 17463, VII-C to G described above.

Cyan couplers, magenta couplers and yellow couplers preferably used in the present invention are represented by formulae (C-I), (C-II), (M-I), (M-II) and (Y).

(C-I)

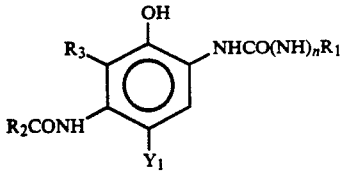

(C-II)

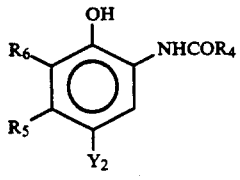

(M-I)

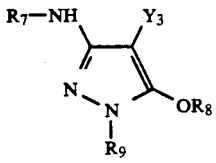

(M-II)

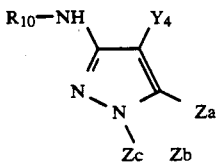

(Y)

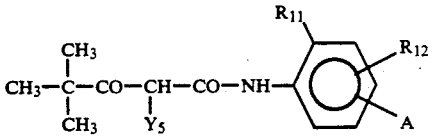

In the formula (C-I) and (C-II), each of $R_1$, $R_2$ and $R_4$ represents a substituted or unsubstituted aliphatic (having 1 to 40 carbon atoms), aromatic (having 6 to 50 carbon atoms) or heterocyclic (having 4 to 50 carbon atoms) group; each of $R_3$, $R_5$ and $R_6$ represents a hydrogen atom, a halogen atom, an aliphatic group, an aromatic group or an acylamino group; $R_3$ may represent a nonmetallic atom which combines together with $R_2$ to form a nitrogen-containing 5-membered or 6-membered ring; each of $Y_1$ and $Y_2$ represents a hydrogen atom or a group which is capable of releasing by coupling reaction with an oxidation product of a developing agent; and n represents 0 or 1.

Examples of the substituents for $R_1$, $R_2$ and $R_4$ include acyl groups, acyloxy groups, acylthio groups, acylamino groups, alkoxy groups, alkoxycarbonyl groups, arylkoxy groups, aryloxycarbonyl groups, alkoxycarbonylamino groups, aryloxycarbonylamino groups, alkoxyamino groups, aryloxyamino groups, alkoxyaminocarbonyl groups, aryloxyaminocarbonyl groups, alkyloxysulfonamide groups, aryloxysulfonamide groups, alkyloxysulfamoyl groups, aryloxysulfamoyl groups, alkylsulfonyl groups, arylsulfonyl groups, alkylsulfinyl groups, arylsulfinyl groups, alkylsulfonamide groups, arylsulfonamide groups, alkylsulfamoyl groups, arylsulfamoyl groups, alkylcarbamoyl groups, arylcarbamoyl groups, alkylthio groups, arylthio groups, alkylamino groups, dialkylamino groups, arylamino groups, diarylamino groups, hydroxyl groups, halogen atoms, cyano groups, alkylureide groups, arylureide groups, mercapto groups and aryl groups.

$R_5$ is preferably an aliphatic group. Examples thereof include methyl, ethyl, propyl, butyl, pentadecyl, tert-butyl, cyclohexyl, cyclohexylmethyl, phenylthiomethyl, dodecyloxyphenylthiomethyl, butaneamidomethyl and methoxymethyl.

$R_1$ is preferably an aryl group or a heterocyclic group, and more preferably an aryl group substituted with a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group or a cyano group.

When $R_3$ and $R_2$ does not form a ring, $R_2$ is preferably a substituted or unsubstituted alkyl or aryl group, and more preferably, an alkyl group substituted by a substituted aryloxy. $R_3$ is preferably a hydrogen atom.

$R_4$ is preferably a substituted or unsubstituted alkyl or aryl group, and more preferably, an alkyl group substituted by a substituted aryloxy.

$R_5$ is preferably an alkyl group having 2 to 15 carbon atoms or a methyl group having a substituent of at least one carbon atom. As the substituent, there is preferably used an arylthio group, an alkylthio group, an acylamino group, an aryloxy group or an alkyloxy group.

$R_5$ is more preferably an alkyl group having 2 to 15 carbon atoms, and an alkyl group having 2 to 4 carbon atoms is particularly preferable.

$R_6$ is preferably a hydrogen atom or a halogen atom, and particularly a chlorine atom or a fluorine atom is more preferable. $Y_1$ and $Y_2$ are each preferably a hydrogen atom, a halogen atom, an alkoxy group, an aryloxy group, an acyloxy group or a sulfonamido group.

In the formula (M-I), each of $R_7$ and $R_9$ represents an aryl group; $R_8$ represents a hydrogen atom, an aliphatic or aromatic acyl group, or an aliphatic or aromatic sulfonyl group; and $Y_3$ represents a hydrogen atom or a releasing group.

Substituent groups permissible for the aryl groups (preferably phenyl groups) of $R_7$ and $R_9$ are the same as substituents permissible for $R_1$. If there are two or more substituents, they may be the same or different. $R_8$ is preferably a hydrogen atom, an aliphatic acyl or sulfonyl group, and more preferably a hydrogen atom. $Y_3$ is preferably a group which is released at a sulfur atom, an oxygen atom or a nitrogen atom. For example, groups of the sulfur atom releasing type as described in U.S. Pat. No. 4,351,897 and PCT International Publication No. W088/04795 are particularly preferable.

In formula (M-II), $R_{10}$ represents a hydrogen atom or a mere substituent group. $Y_4$ represents a hydrogen atom or an releasing group, and preferably a halogen atom or an arylthio group. Each of Za, Zb and Zc represents methine, substituted methine, =N— or —NH—. One of the Za—Zb bond and the Zb—Zc bond is a double bond and the other is a single bond. When the Zb—Zc bond is a carbon-carbon double bond, it may constitute a part of an aromatic ring. When a dimer or a multimer is formed by $R_{10}$ or $T_4$, and when Za, Zb or Zc is a substituted methine, the couplers include a dimer or a multimer formed by the substituted methine.

Of the pyrazolotriazole couplers represented by formula (M-II), the imidazo[1,2-b]pyrazoles described in U.S. Pat. No. 4,500,630 are preferable in respect to the decreased yellow side adsorption and the light fastness of color forming dyes. In particular, pyrazolo[1,5-b][1,2,4]triazole described in U.S. Pat. No. 4,540,654 is preferable.

In addition, there are preferably used a pyrazolotriazole coupler having a branched alkyl group directly connected to the 2-, 3- or 6-position of a pyrazolotriazole ring as described in JP-A-61-65245, a pyrazoloazole coupler containing a sulfonamido group in its molecule as described in JP-A-61-65246, a pyrazoloazole coupler having an alkoxyphenylsulfonamido ballast group as described in JP-A-61-147254, and a pyrazolotriazole coupler having an alkoxy group or an aryloxy group at the 6-position of a pyrazolotriazole ring as described in European Patents 226,849 and 294,785.

In the formula (Y), $R_{11}$ represents a halogen atom, an alkoxy group, a trifluoromethyl group or an aryl group, and $R_{12}$ represents a hydrogen atom, a halogen atom or an alkoxy group. A represents $-NHCOR_{13}$, $-NHSO_2-R_{13}$, $-SO_2NHR_{13}$, $-COOR_{13}$ and $$-SO_2\underset{\underset{R_{14}}{|}}{N}-R_{13},$$

provided that each of $R_{13}$ and $R_{14}$ represents an alkyl group, an aryl group or an acyl group. Y5 represents an releasing group. Substituents for $R_{12}$, $R_{13}$ and $R_{14}$ are the same as the substituents permissible for $R_1$. The releasing group $Y_5$ is preferably a group which is released at an oxygen atom or a nitrogen atom. In particular, groups of the nitrogen releasing type are preferable.

Specific examples of the couplers represented by general formulae (C-I), (C-II), (M-I), (M-II) and (Y) are enumerated below.

(C-1)

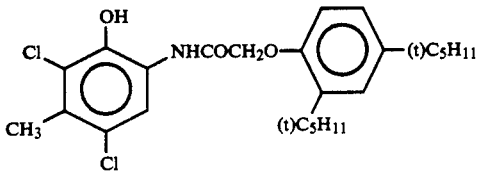

(C-2)

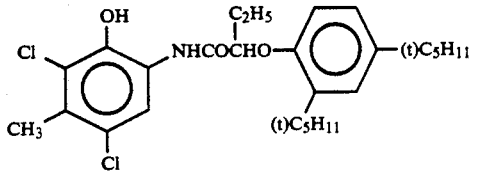

(C-3)

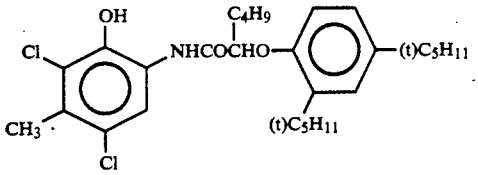

(C-4)

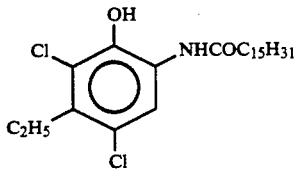

(C-5)

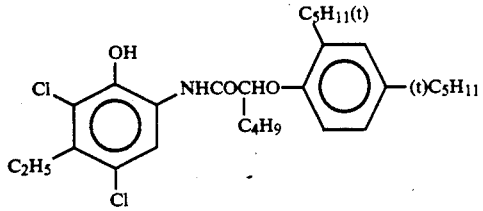

(C-6)

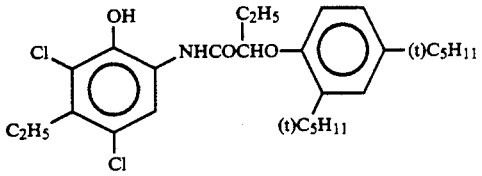

(C-7)

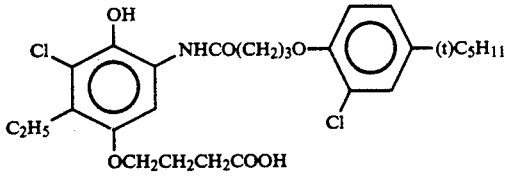

(C-8)

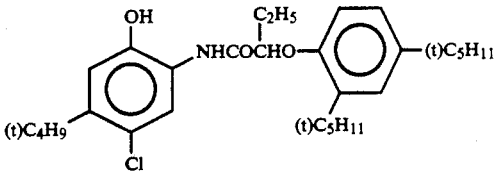

(C-9)

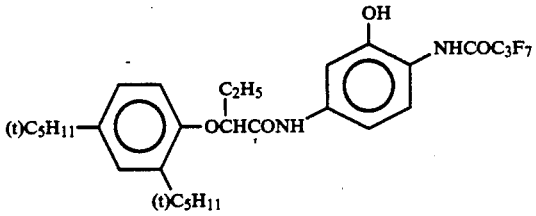

(C-10)

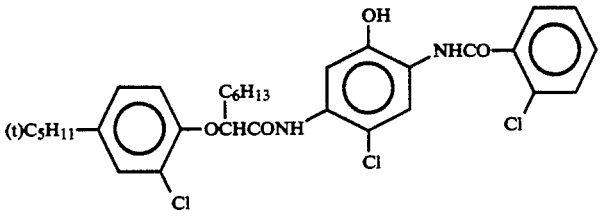

-continued
(C-11)
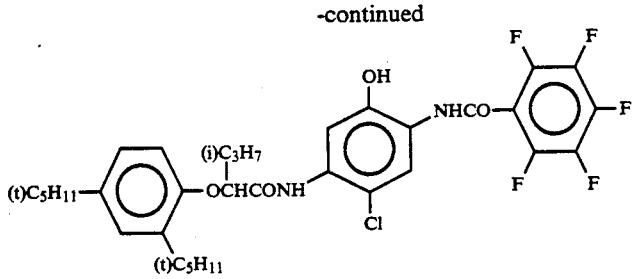
(C-12)
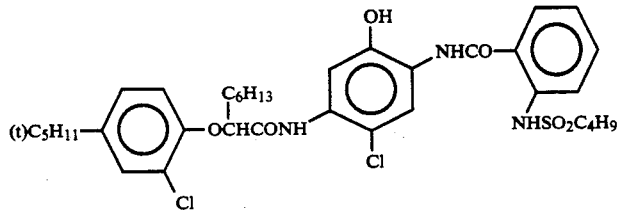
(C-13)
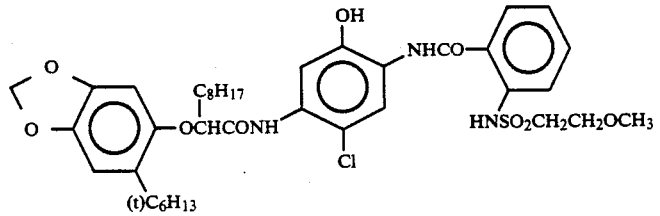
(C-14)
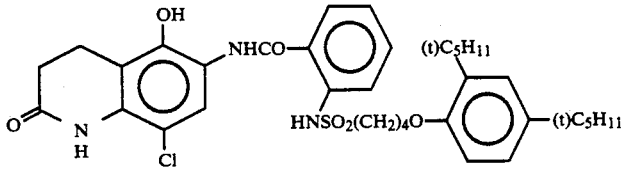
(C-16)
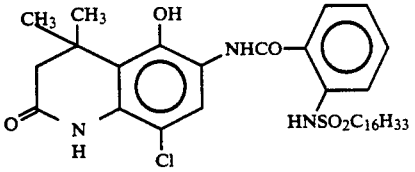
(C-15)
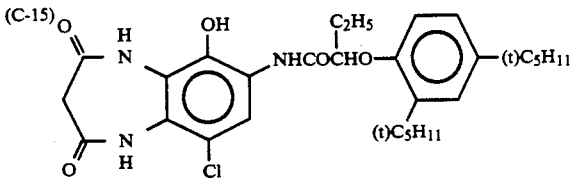
(C-17)
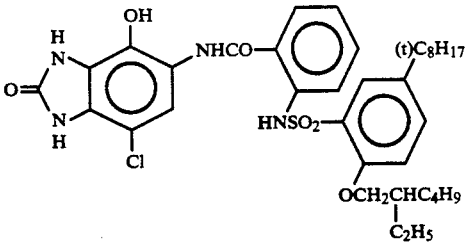
(C-18)
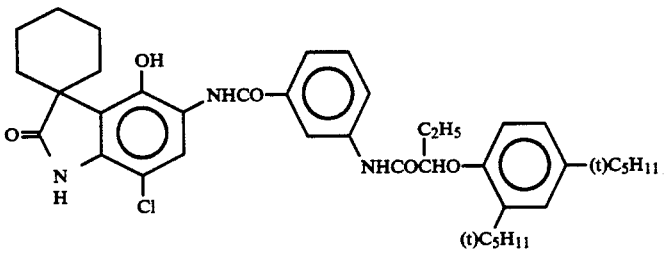

-continued
(C-19)
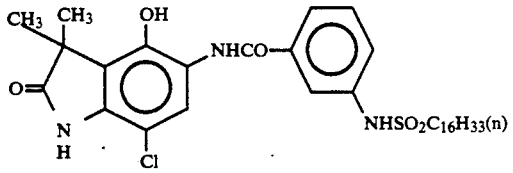
(C-20)
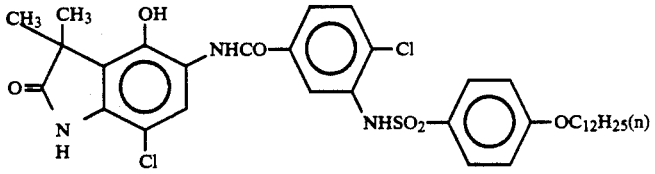
(C-21)
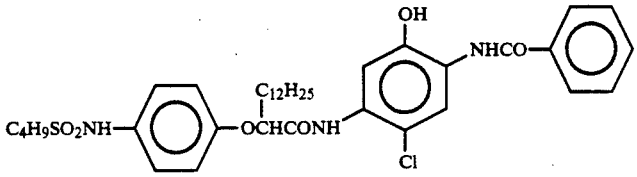
(C-22)
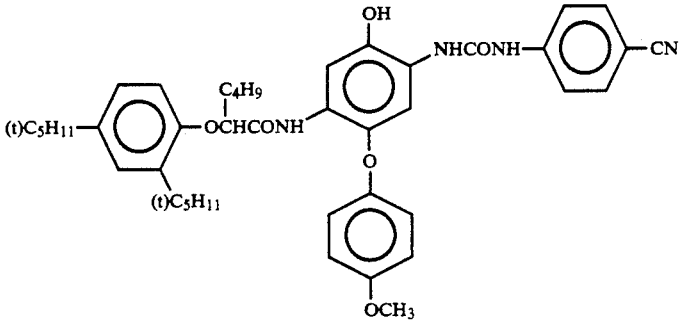
(M-1)
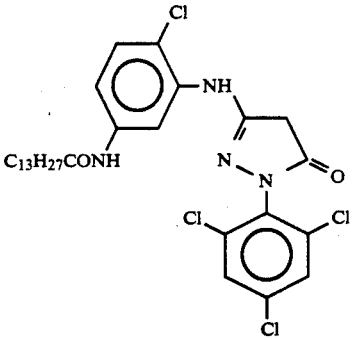
(M-2)
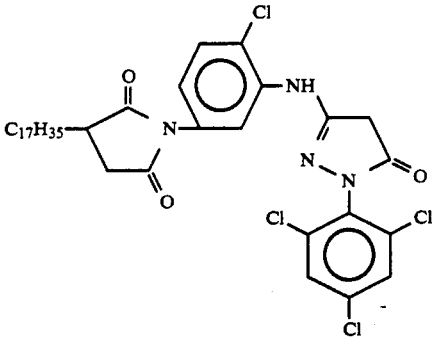
(M-3)
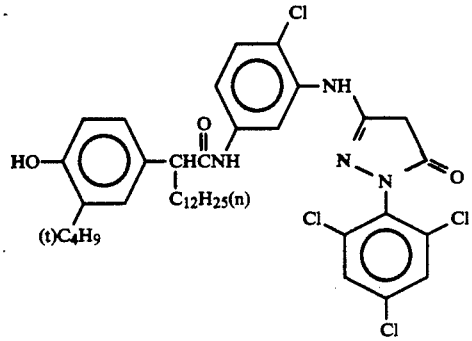
(M-4)
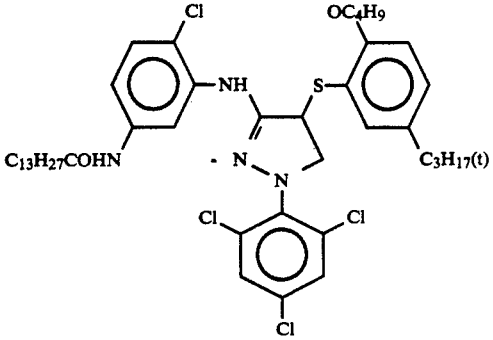

-continued
(M-5)
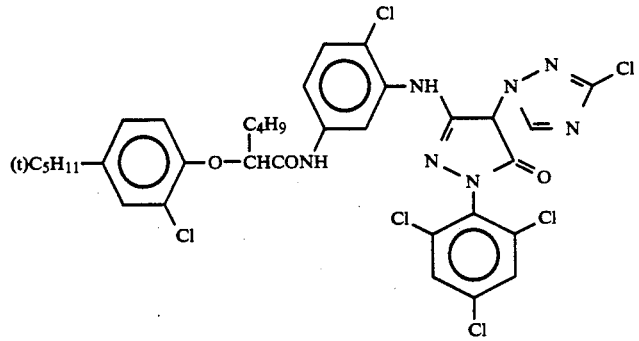
(M-6)
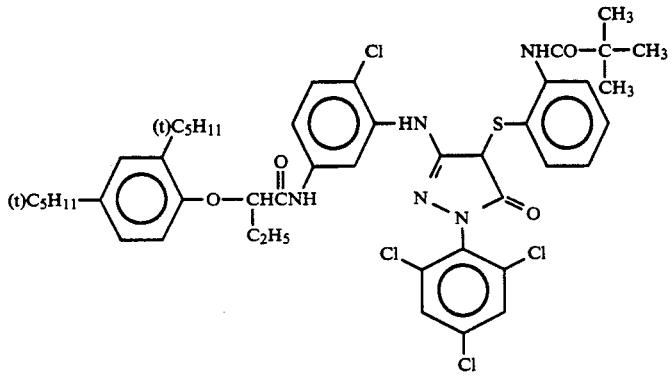
(M-7)
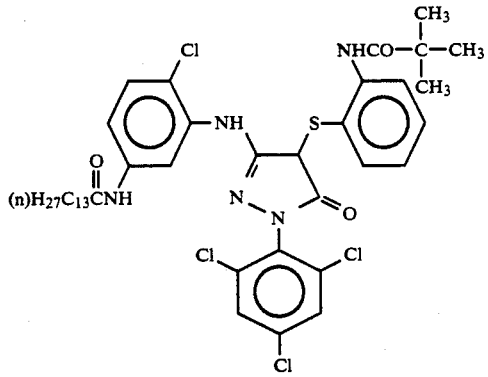
(M-8)
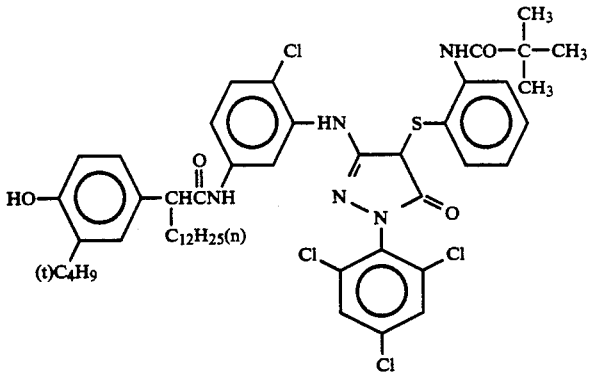

| Compound | $R_{10}$ | $R_{15}$ | $Y_4$ |
|---|---|---|---|
| | | 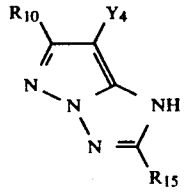 | |
| M-9 | $CH_3$— | 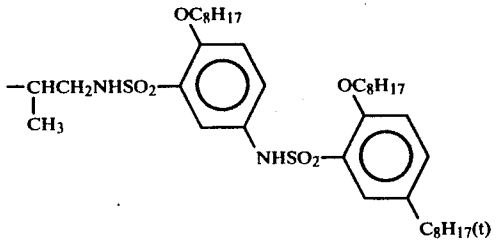 | Cl |
| M-10 | " | 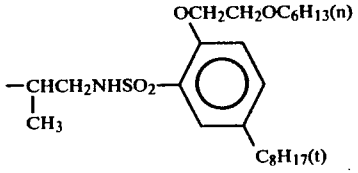 | " |
| M-11 | $(CH_3)_3C$— | 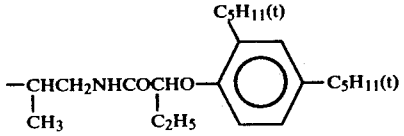 | 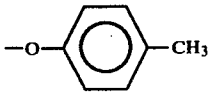 |
| M-12 | 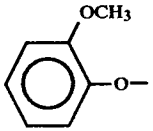 | 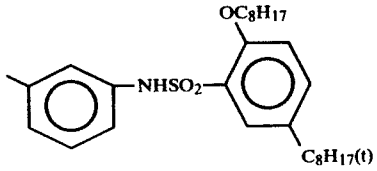 | 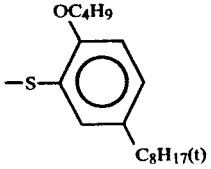 |

-continued
| Compound | $R_{10}$ | $R_{15}$ | $Y_4$ |
|---|---|---|---|
| M-13 | $CH_3$— | 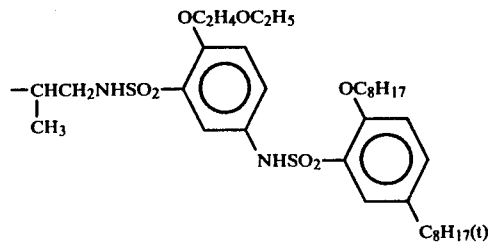 | Cl |
| M-14 | " | 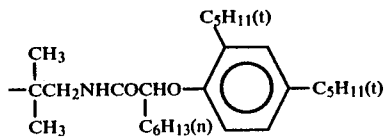 | " |
| M-15 | $CH_3$— | 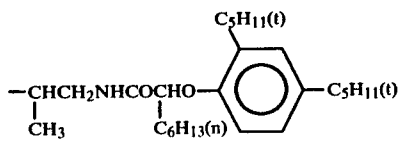 | Cl |
| M-16 | " | 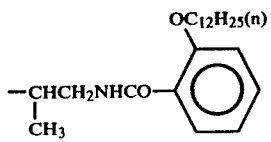 | " |
| M-17 | " | 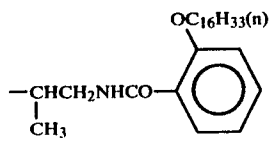 | " |

-continued
| Compound | $R_{10}$ | $R_{15}$ | $Y_4$ |
|---|---|---|---|
| M-18 | 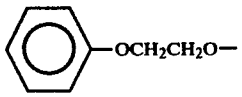 | 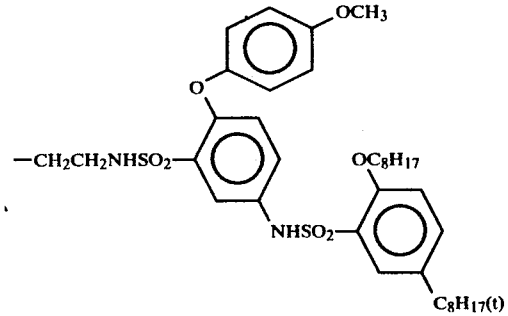 | 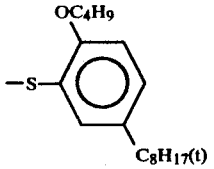 |
| M-19 | $CH_3CH_2O-$ | " | " |
| M-20 | 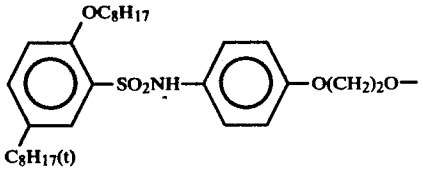 | 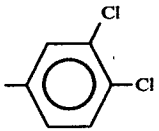 | 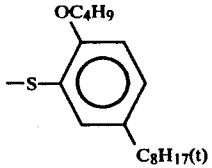 |
| M-21 | 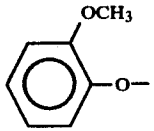 | 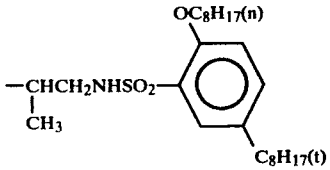 | Cl |
| M-22 | $CH_3-$ | 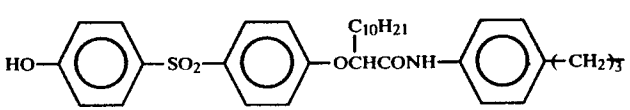 | Cl |

-continued

| Compound | $R_{10}$ | $R_{15}$ | $Y_4$ |
|---|---|---|---|
| M-23 | " | $(n)C_6H_{13}$, $(n)C_8H_{17}$ $CHCH_2SO_2(CH_2)_2$ | " |
| M-24 | $CH_3$, $CH_3$ $CH-$ | $OC_4H_9$, $SO_2(CH_2)_3$, $C_8H_{17}(t)$ | " |
| M-25 | $(CH-CH_2)_{50}(CH_2-C)_{50}$ ($CH_3$; $COOCH_2CH_2OCH_3$; $CONH-$) | $CH_3-CH-$ ($CH_2NHSO_2CH_3$) | " |
| M-26 | $-O-$ | $OC_8H_{17}$, $(CH_2)_2NHSO_2$, $C_8H_{17}(t)$ | Cl |
| M-27 | $CH_3-$ | $CH_3$, $CH_3$, $CH_3$, $NHCOCHO$ ($(n)C_{10}H_{21}$), $SO_2$, $OCH_2$ | " |
| M-28 | $(CH_3)_3C-$ | $CH_3$, $CH_3$, $CH_3$, $C_5H_{11}(t)$, $NHCOCHO$ ($C_4H_9(n)$), $C_5H_{11}(t)$ | " |

-continued
| Compound | $R_{10}$ | $R_{15}$ | $Y_4$ |
|---|---|---|---|
| M-29 | 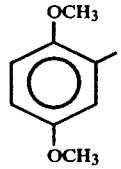 | 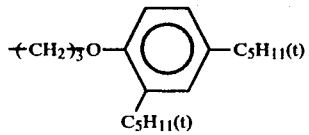 | Cl |
| M-30 | $CH_3$— | $-CH(C_2H_5)-NCOCH_2CH_2COOH$, with (n)$C_{18}H_{37}$ | " |

(Y-1)
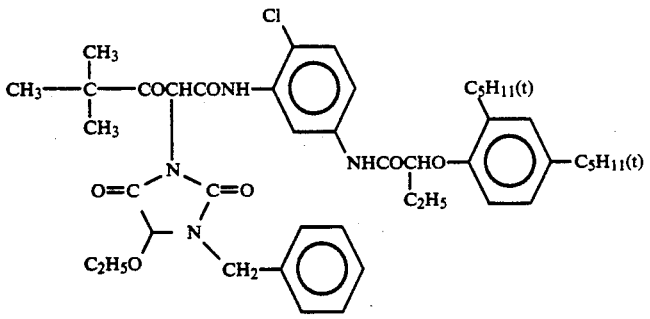
(Y-2)
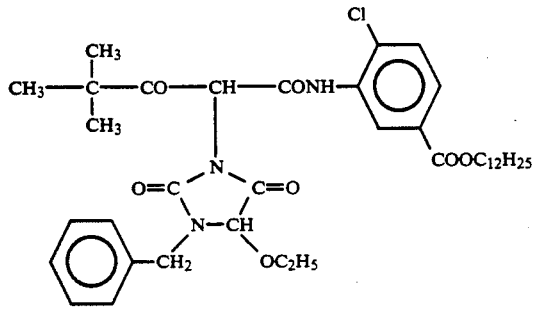
(Y-3)
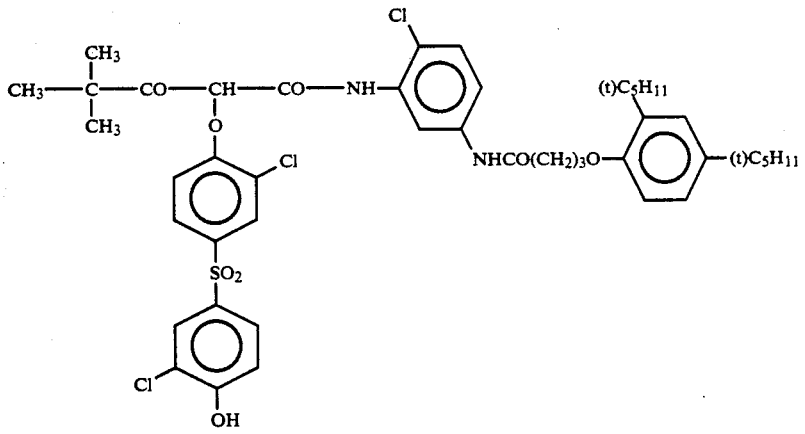
(Y-4)
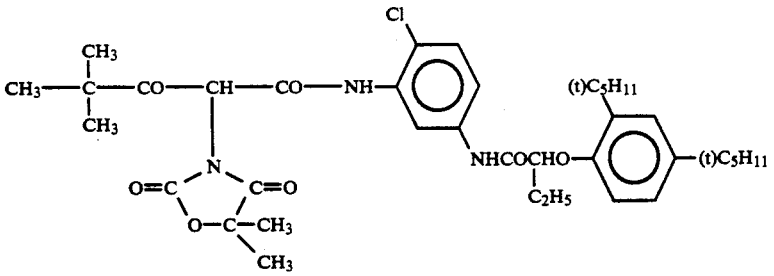
(Y-5)
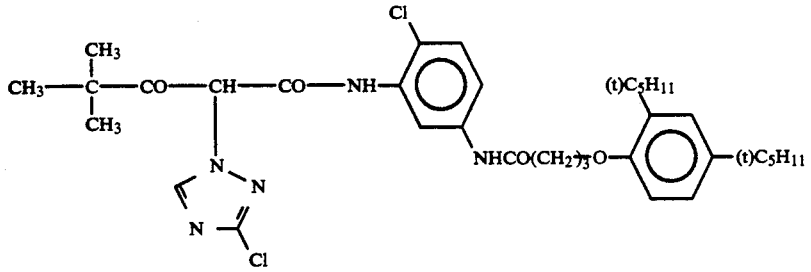

-continued
(Y-6)
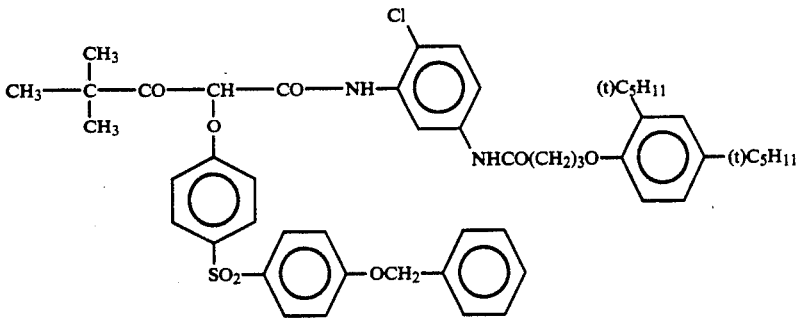
(Y-7)
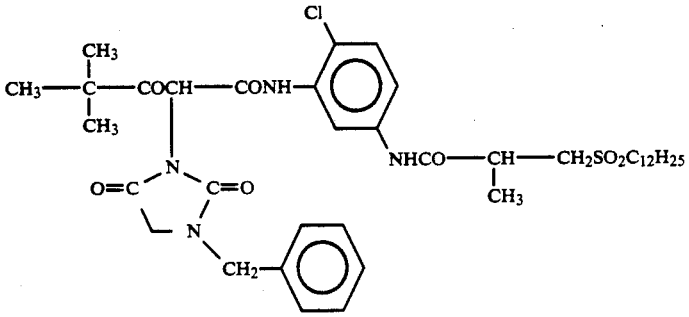
(Y-8)
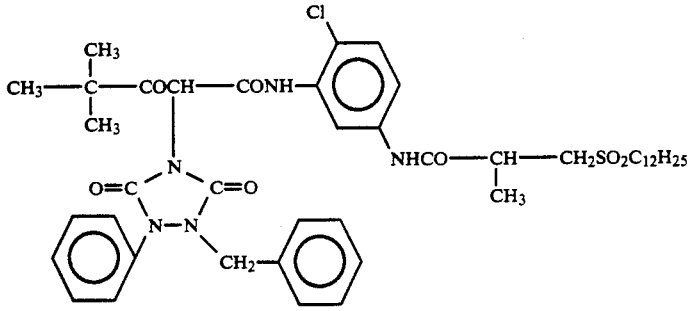
(Y-9)
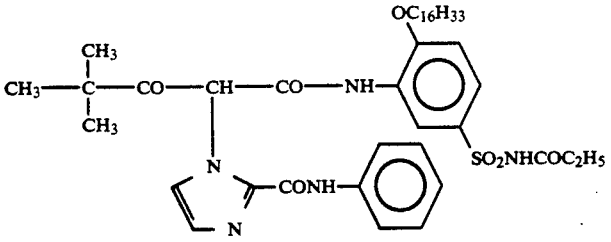
(Y-10)
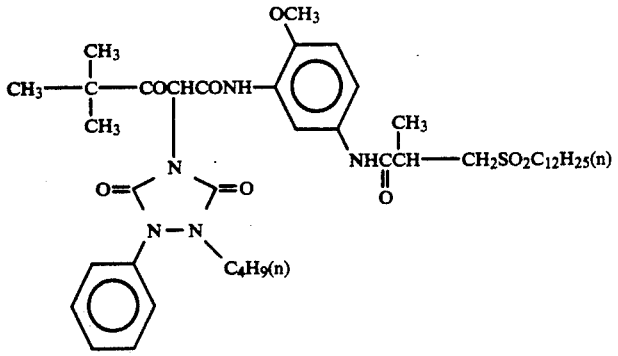

-continued (Y-11)

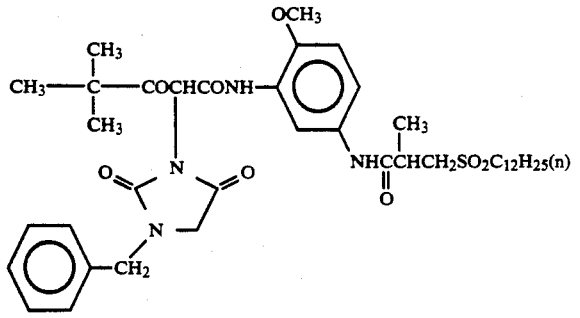

(Y-12)

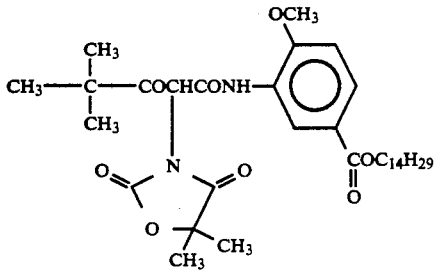

(Y-13)

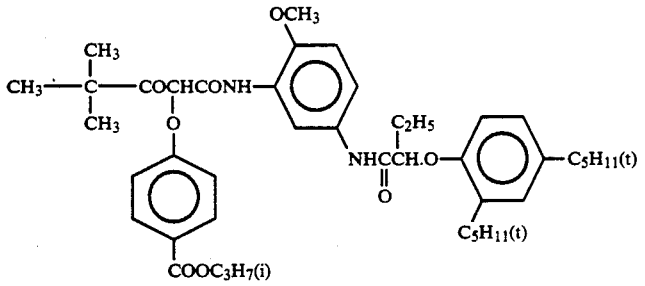

Colored couplers for correcting unnecessary absorption of forming dyes may also be used. Preferred examples of such couplers are described in *Research Disclosure*, No. 17643, Item VII-G, U.S. Pat. Nos. 4,004,929, 4,138,258 and 4,163,670, JP-B-57-39413 and British Patent 1,146,368. It is also preferred to use couplers for correcting unnecessary absorption of forming dyes with fluorescent dyes released on coupling and couplers having dye precursor groups as releasing groups which can form dyes by reacting with developing agents. The former couplers are described in U.S. Pat. No. 4,774,181 and the latter couplers are described in U.S. Pat. No. 4,777,120.

As couplers whose forming dyes have appropriate diffusibility, those described in U.S. Pat. No. 4,366,237, British Patent 2,125,570, European Patent 96,571 and West German Patent (OLS) 3,234,533 are preferable.

Typical examples of polymerized dye-forming couplers are described in U.S. Pat. Nos. 3,451,820, 4,080,211, 4,367,282, 4,409,320 and 4,576,910 and British Patent 2,102,173.

Couplers which release photographically useful residues on coupling can be used in the present invention. Preferred DIR couplers which release development inhibitors are described in the patents cited in *Research Disclosure*, No. 17643, Item VII-F, JP-A-57-151944, JP-A-57-154234, JP-A-60-184248, JP-A-63-37346 and U.S. Pat. No. 4,248,962 and 4,782,012.

Preferred couplers which release nucleating agents or development accelerators in image-like forms are described in British Patents 2,097,140 and 2,131,188, JP-A-59-157638 and JP-A-59-170840.

Other couplers used in combination in the present invention include competitive couplers described in U.S. Pat. No. 4,130,427, multiequivalent couplers described in U.S. Pat. Nos. 4,283,472, 4,338,393 and 4,310,618, DIR redox compound releasing couplers, DIR coupler releasing couplers, DIR coupler releasing redox compounds and DIR redox compound releasing redox compounds described in JP-A-60-185950 and JP-A-62-24252, couplers which release dyes recoloring after elimination described in European Patent 173,302A, breaching accelerator releasing couplers described in *Research Disclosure*, No. 11449, *Research Disclosure*, No. 24241 and JP-A-61-201247, ligand releasing couplers described in U.S. Pat. No. 4,553,477, leuco dye releasing couplers described in JP-A-63-75747 and fluorescent dye releasing couplers described in U.S. Pat. No. 4,774,181.

The standard amount of the color couplers used in the present invention ranges from 0.001 to 1 mol per mol of light-sensitive silver halide. The amount is preferably 0.01 to 0.5 mol for yellow couplers, 0.003 to 0.3 mol for magenta couplers, and 0.002 to 0.3 mol for cyan couplers.

The compounds of the present invention and the color couplers can be incorporated in the photographic materials by various conventional dispersion methods. Usually, the compound of the present invention and the color coupler can be added by oil-in-water dispersion methods known as oil protect methods, in which they are dispersed and emulsified in an aqueous solution of gelatin containing a surfactant after dissolved in a solvent. Alternatively, water or an aqueous solution of gelatin may be added to a solution of the compound of the present invention and the color coupler containing a surfactant to form an oil-in-water dispersion by phase inversion. The compounds of the present invention and the color couplers which are soluble in alkalis can also be dispersed by so-called Fisher dispersion methods. The dispersion of the compound of the present invention and the color coupler may be incorporated in a photographic emulsion, after removing a low boiling point organic solvent by distillation, noodle washing or ultrafiltration. It is preferred to use high boiling point organic solvents and/or water-insoluble high polymer compounds having a dielectric constant (at 25° C.) of 2 to 20 and an index of refraction (at 25° C.) of 1.5 to 1.7, as dispersing media for the compounds of the present invention and the color couplers.

Examples of the high boiling solvents used in the oil-in-water dispersion methods are described in U.S. Pat. No. 2,322,027. Further, the stages and effects of dispersion methods using latexes, which belong to polymer dispersion methods, and specific examples of the latexes for impregnation are described in U.S. Pat. No. 4,199,363 and West German Patents (OLS) 2,541,274 and 2,541,230. Dispersion methods using solvent-soluble organic polymers are described in PCT International Publication No. W088/00723.

The high boiling point organic solvents which can be used in the above-described oil-in-water dispersion methods include phthalates [for example, dibutyl phthalate, dioctyl phthalate, dicyclohexyl phthalate, di-2-ethylhexyl phthalate, decyl phthalate, bis(2,4-di-t-amylphenyl)isophthalate and bis(1,1-diethylpropyl)-phthalate, phosphates or phosphonates (for example, diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, dodecyl phosphate and di-2-ethylhexylphenyl phosphonate), benzoates (for example, 2-ethylhexyl benzoate, 2,4-dichlorobenzoate, dodecyl benzoate and 2-ethylhexyl-p-hydroxy benzoate), amides (for example, N,N-diethyldodecaneamide and N,N-diethyllaurylamide), alcohols or phenols (for example, isostearyl alcohol and 2,4-di-tert-amyl phenol), aliphatic esters (for example, dibutoxyethyl succinate, di-2-ethylhexyl succinate, 2-hexyldecyl tetradecanoate, tributyl citrate, diethyl azelate, isostearyl lactate and trioctyl citrate), aniline derivatives (for example, N,N-dibutyl-2-butoxy-5-tert-octylaniline), chlorinated paraffins (for example, paraffins having a chlorine content of 10 to 80%), trimesates (for example, tributyl trimesate), dodecylbenzene and diisopropylnaphthalene. Organic solvents having a boiling point of about 30 to about 160° C. may also be used in combination therewith as auxiliary solvents. Examples of such organic solvents include ethyl acetate, butyl acetate, ethyl propionate, methyl ethyl ketone, cyclohexanone, 2-ethoxyethyl acetate and dimethylformamide.

The photographic materials of the present invention may contain color antifoggants such as hydroquinone derivatives, aminophenol derivatives, gallic acid derivatives and ascorbic acid derivatives.

The photographic materials of the present invention may also contain various antifading agents. Namely, typical examples of organic antifading agents for cyan, magenta and/or yellow images include hindered phenols such as hydroquinones, 6-hydroxychromans, 5-hydroxycoumarans, spirochromans, p-alkoxyphenols and bisphenols, gallic acid derivatives, methylenedioxybenzenes, aminophenols, hindered amines, and ether or ester derivatives obtained by silylating or alkylating phenolic hydroxyl groups of these compounds. Further, metal complexes represented by (bissalicylaldoximato)-nickel complexes and (bis-N,N-dialkyldithiocarbamato)nickel complexes can also be used.

Specific examples of the organic antifading agents include hydroquinones described in U.S. Pat. Nos. 2,360,290, 2,418,613, 2,700,453, 2,701,197, 2,728,659, 2,732,300, 2,735,765, 3,982,944, 4,430,425, 2,710,801 and 2,816,028 and British Patent 1,363,921; 6-hydroxychromans, 5-hydroxycoumarans and spirochromans described in U.S. Pat. Nos. 3,432,300, 3,573,050, 3,574,627, 3,698,909 and 3,764,337 and JP-A-52-152225; spiroindanes described in U.S. Pat. No. 4,360,589; p-alkoxyphenols described in U.S. Pat. No. 2,735,765, British Patent 2,066,975, JP-A-59-10539 and JP-B-57-19765; hindered phenols described in U.S. Pat. Nos. 3,700,455 and 4,228,235, JP-A-52-72224 and JP-B-52-6623; gallic acid derivatives described in U.S. Pat. Nos. 3,457,079; methylenedioxybenzenes described in U.S. Pat. 4,332,886; aminophenols described in JP-B-56-21144; hindered amines described in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344; and metal complexes described in U.S. Patents 4,050,938 and 4,241,155 and British Patent 2,027,731(A). Each of these compounds is usually emulsified together with each corresponding color coupler in an amount of 5 to 100% by weight based on the weight of the coupler and the resulting emulsion is added to the light-sensitive emulsion layer. In order to prevent cyan dye images from deterioration due to heat and particularly light, it is more effective to introduce an ultraviolet absorber in a cyan color forming layer and layers on both sides adjacent thereto.

As ultraviolet absorbers, there can be used benzotriazole compounds substituted by aryl groups (for example, the compounds described in U.S. Pat. No. 3,533,794), 4-thiazolidone compounds (for example, the compounds described in U.S. Pat. Nos. 3,314,794 and 3,352,581), benzophenone compounds (for example, the compounds described in JP-A-46-2784), cinnamate compounds (for example, the compounds described in U.S. Pat. Nos. 3,705,805 and 3,707,395), butadiene compounds (for example, the compounds described in U.S. Pat. No. 4,045,229) and benzoxidol compounds (for example, the compounds described in U.S. Pat. Nos. 3,406,070 and 4,271,307). Ultraviolet-absorptive couplers (for example, o-naphthol cyan dye forming couplers) and ultraviolet-absorptive polymers may also be used. These ultraviolet absorbers may also be mordanted to a specific layer.

In particular, above-described benzotriazole compounds substituted by aryl groups are preferably used.

Gelatin can be advantageously used as a binder or a protective colloid for emulsion layers of the photographic materials of the present invention, However, hydrophilic colloids other than gelatin may be used alone or in combination with gelatin.

Gelatin used in the present invention may be either treated with lime or treated with an acid. The details of the methods for preparing gelatin are described in Arthur Vice, *The Macromolecular Chemistry of Gelatin* (Academic Press, 1964).

It is preferred to add various preservatives and antifungal agents to the photographic materials of the present invention. Examples of such preservatives and antifungal agents include 1,2-benzisothiazoline-3-one, n-butyl-p-hydroxybenzoate, phenol, 4-chloro-3,5-dimethylphenol, 2-phenoxyethanol and 2-{4-thiazolyl}benzimidazole described in JP-A-63-257747, JP-A-62-272248 and JP-A-1-80941.

When the photographic materials of the present invention are the direct positive color photographic materials, nucleating agents such as hydrazine compounds and quaternary heterocyclic compounds described in Research Disclosure, No. 22534 (January, 1983) and nucleating accelerators for enhancing the function of the nucleating agents may be used.

In the present invention, a transparent film such as a cellulose nitrate film or a polyethylene terephthalate film, or a reflecting support, which is usually used for photographic materials, can be used as the support. For the purpose of the present invention, it is more preferable to use the reflecting support.

The "reflecting support" preferably used in the present invention means a support whose reflectivity is increased to clarify dye images formed on halogen halide emulsion layers. Such supports include supports coated with hydrophobic resins containing light reflective materials such as titanium dioxide, zinc oxide, calcium carbonate and calcium sulfate dispersed therein, and supports formed of hydrophobic resins containing light reflective materials dispersed therein. Examples thereof include baryta paper, polyethylene-coated paper, synthetic polypropylene paper and transparent supports provided with reflective layers or containing reflective materials (for example, glass plates, cellulose films such as cellulose triacetate films and cellulose nitrate films, polyester films such as polyethylene terephthalate films, polyamide films, polycarbonate films, polystyrene films and vinyl chloride resins.

The photographic materials according to the present invention can be developed by conventional methods described in *Research Disclosure,* No. 17643, pages 28 and 29 and ibid., No. 18716, page 615, left column to right column. For example, color development, desilverization and washing are carried out. In the desilverization stage, bleach-fixing treatment may also be conducted using a bleaching-fixing solution, in place of bleaching using a bleaching solution and fixing using a fixing solution, and bleaching, fixing and bleach-fixing may be combined with one another in any order. Stabilization may be carried out instead of or after washing. Further, mono bath processing using a combined developing, bleaching and fixing solution for performing color development, bleaching and fixing in one bath can be carried out. Pre-hardening, neutralization thereof, stopping fixing, post-hardening, compensation and intensification may be combined with these processing stages. An intermediate washing stage may be arbitrarily provided between the above-described stages. In these processings, so-called activator processing may be carried out in place of the color development.

The color developing solutions used for development of the photographic materials of the present invention are preferably aqueous alkaline solutions mainly containing the aromatic primary amine color developing agents. Although aminophenol compounds are useful as the color developing agents, p-phenylenediamine compounds are preferably used. Typical examples thereof include 3-methyl-4-amino-N,N-diethylaniline, 3-methyl-4-amino-N-ethyl-N-8-hydroxyethylaniline, 3-methyl-4-amino-N-ethyl-N-8-methanesulfonamidoethylaniline, 3-methyl-4-amino-N-ethyl-N-8-methoxyethylaniline, and sulfates, hydrochlorides and p-toluenesulfonates thereof. Of theses compounds, 3-methyl-4-amino-N-ethyl-N-8-methanesulfonamidoethylaniline sulfate and 3-methyl-4-amino-N-ethyl-N-8-hydroxyethylaniline sulfate are particularly preferable. Two or more kinds of these compounds can also be used in combination with one another depending on the purposes.

The color developing solutions generally contain pH buffers such as alkali metal carbonates, borates and phosphates, and development inhibitors or antifoggants such as chlorides bromides, iodides, benzimidazoles, benzothiazoles and mercapto compounds. Further, the color developing solutions may contain hydrazines such as hydroxylamine, diethylhydroxylamine, sulfites and N,N-biscarboxymethylhydrazine; various preservatives such as phenylsemicarbazides, triethanolamine and catechol sulfonic acids; organic solvents such as ethylene glycol and diethylene glycol; development accelerators such as benzyl alcohol, polyethylene glycol, quaternary ammonium salts and amines; dye forming couplers; competitive couplers; auxiliary developing agents such as 1-phenyl-3-pyrazolidone; nucleating agents such as sodium boron hydride and hydrazine compounds; viscosity-imparting agents (tackifiers); various chelating agents represented by aminopolycarboxylic acids, aminopolyphosphonic acids, alkylphosphonic acids and phosphonocarboxylic acids [for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediaminedi(o-hydroxyphenylacetic acid) and salts thereof]; fluorescent brightening agents such as 4,4'-diamino-2,2'-disulfostilbene compounds; and various surfactants such as alkylsulfonic acids, arylsulfonic acids, aliphatic carboxylic acids and aromatic carboxylic acids. The pH of these color developing solutions is generally 9 to 12.

In general, black-and-white development, washing or rinsing, reversal processing and color development are carried out as color reversal development. In the reversal processing stage, a reversal bath containing a fogging agent may be used, or light reversal processing may be performed. The reversal processing stage may also be omitted by using a color developing solution containing the above-described fogging agent.

Black-and-white developing solutions used for the black-and-white development are ones used for treatment of conventional black-and-white photographic materials, and may contain various additives which are generally added to the black-and-white developing solutions.

Typical examples of such additives include developing agents such as 1-phenyl-3-pyrazolidone, N-methyl-p-aminophenol and hydroquinone; preservatives such as sulfites; pH buffers comprising water-soluble acids such as acetic acid and boric acid; pH buffers or development accelerators comprising alkali compounds such as sodium hydroxide, sodium carbonate and potassium carbonate; inorganic or organic development inhibitors such as potassium bromide, 2-methyl-benzimidazole and methylbenzthiazole; hard water softeners such as ethylenediaminetetraacetic acid and polyphosphates; antioxidants such as ascorbic acid and diethanolamine; organic solvents such as triethylene glycol and cellosolves; and surface overdevelopment inhibitors such as slight amounts of iodides and mercapto compounds.

The replenishment rate of these developing solutions varies depending on the type of color photographic material to be treated, but is usually not more than 3 liters per square meter of photographic sensitive material. By reducing the ion concentration of the bromide in the replenisher, the replenishment rate can also be decreased to 500 ml/m$^2$ or less. When the replenishment rate is decreased, it is preferred to reduce the contact area of the processing solution with air to prevent the solution from evaporation and air oxidation.

Methods for reducing the contact area of the processing solution with air like this include the method using the movable lid described in JP-A-1-82033 and the slit developing method described in JP-A-63-216050, as well as a method in which a shield such as a floating lid is provided on the surface of the photographic processing solution in the processing tank. This technique is preferably applied not only to both stages of color development and black-and-white development, but also to succeeding stages, for example, all stages of bleaching, bleach-fixing treatment, fixing, washing, stabilizing and the like. The replenishment rate can also be decreased by depressing accumulation of the bromide ions in the developing solution.

The time of the color development processing is usually established between 2 minutes and 5 minutes. However, the elevated temperature, the higher pH and the use of the color developing solution high in concentration can further reduce the processing time.

After color development, the photographic emulsion layer is desilverized. In desilverization, bleaching may be carried out separately or simultaneously with fixing (bleach-fixing treatment). The bleach-fixing treatment may be conducted after bleaching to expedite processing. A treatment with a bleach-fixing bath composed of two consecutive tanks, fixing prior to the bleach-fixing treatment, or bleaching after the bleach-fixing treatment may be arbitrarily carried out depending on the purpose.

Examples of bleaching agents used for the bleaching solutions or the bleach-fixing solutions include iron salts; compounds of polyvalent metals such as iron (III), cobalt (III), chromium (IV) and copper (II); peroxy acids; quinones; and nitro compounds. Typical examples of the bleaching agents include iron chlorides, ferricyanides, bichromates, organic complexes of iron (III) (for example, complex salts of iron (III) with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid), persulfates, bromates, permanganates and nitrobenzene compounds. Of these, the complex salts of iron (III) with aminopolycarboxylic acids including the complex salt of iron (III) with ethylenediaminetetraacetic acid and the complex of iron (III) with 1,3-diaminopropanetetraacetic acid are preferable from the viewpoint of rapid processing and prevention of environmental pollution. Further, the complex salts of iron (III) with aminopolycarboxylic acids are also particularly useful for both the bleaching solutions and bleach-fixing solutions. The bleaching solutions or the bleach-fixing solutions using these complex salts of iron (III) with aminopolycarboxylic acids are used at a pH of 3.0 to 8.0.

Conventional additives may be added to the bleaching solutions or the bleach-fixing solutions. Examples of such additives include rehalogenating agents such as ammonium bromide and ammonium chloride, pH buffers such as ammonium nitrate, and metal-corrosion inhibitors such as ammonium sulfate. For the purpose of preventing bleach stains, it is preferred that the bleaching solution or the bleach-fixing solutions contain organic acids, as well as the above-described compounds. Particularly preferred organic acids are compounds having an acid dissociation constant (pKa) of 2 to 5.5, and specifically, acetic acid and propionic acid are preferable.

Fixing agents used in the fixing solutions or the bleach-fixing solutions include thiosulfates, thiocyanates, thioether compounds, thioureas and large quantities of iodides. The thiosulfates are generally used, and particularly ammonium thiosulfate can be most widely used. It is also preferred to use the thiosulfates in combination with thiocyanates, thioether compounds and thioureas.

As preservatives for the fixing solutions or the bleach-fixing solutions, there can be advantageously used sulfites, bisulfites, carbonyl bisulfite addition compounds or sulfinic compounds described in European Patent 294769A. Furthermore, for the purpose of stabilizing the solutions, it is preferred to add various aminocarboxylic acids or organic phosphonic acids (for example, 1-hydroxyethylidene-1,1-diphosphonic acid and N,N,N',N'-ethylenediaminetetraphosphonic acid) to the fixing solutions or the bleach-fixing solutions.

The fixing solutions or the bleach-fixing solutions may further contain various fluorescent brighteners, defoaming agents, surfactants, polyvinyl pyrrolidone and methanol.

Bleaching accelerator may be added to the bleaching solutions, the bleach-fixing solutions and the preceding baths thereof, if desired. Specific examples of the useful bleaching accelerators include compounds having mercapto groups or disulfide groups described in U.S. Pat. Nos. 3.893.858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and *Research Disclosure*, No. 17129 (July, 1978); thiazolidine derivatives described in JP-A-50-140129; thiourea derivatives described in JP-B-45-8506, JP-A-52-20832, JP-A-53-32735 and U.S. Pat. No. 3,706,561; iodides described in West German Patent 1,127,715 and JP-A-58-16235; polyoxyethylene compounds described in West German Patents 966,410 and 2,748,430; polyamine compounds described in JP-B-45-8836; compounds described in JP-A-49-42434, JP-A-49-59644, JP-A-53-94927, JP-A-54-35727, JP-A-55-26506 and JP-A-58-163940; and bromide ions. The compounds having mercapto groups or disulfide groups are preferable, among others, from the view point of high accelerating effect, and particularly the compounds described in U.S. Pat. No. 3,893,858, West German Patent 1,290,812 and JP-A-53-95630 are preferable. In addition, the compounds described in U.S. Pat. No. 4,552,834 are also preferable. These bleaching accelerators may be added to the photographic materials. When the bleach-fixing treatment of color photographic materials for photography is carried out, these bleaching accelerators are particularly effective.

It is preferred that the total time of desilverization is shorter as long as poor desilverization does not take place. The time is preferably 1 to 3 minutes, and more preferably 1 to 2 minutes. The treating temperature is 25° to 50° C., and preferably 35° to 45° C. Within the preferred temperature range, the rate of desilverization is improved and generation of stains after treatment is effectively prevented.

In the desilverization stage, it is preferred that stirring is performed as fully as possible. Specific methods for performing stirring fully include the method described in JP-A-62-183460 and JP-A-62-183461 in which a jet of a processing solution is collided to the surface of an emulsion layer of a photographic material; the method described in JP-A-62-183461 in which the stirring effect is enhanced by using rotary means; the method of transferring a photographic material while bringing a wiper blade provided in a solution into contact with the surface of an emulsion layer to cause turbulence on the surface, thereby improving the stirring effect; and the method of increasing the circulating flow rate of a whole processing solution. Such means for improving the stirring effect is also effective for all of the bleaching solutions, the bleach-fixing solutions and the fixing solutions. It is conceivable that the improved stirring promotes the supply of the bleaching solutions and the fixing solutions into the emulsion layers, which results in an increase in the rate of desilverization. The above-described means for improving the stirring effect is more effective when the bleaching accelerators are used, and the promoting effect can be significantly increased or the fixing inhibition action due to the bleaching accelerators can be removed.

It is preferred that automatic processors used for the photographic materials of the present invention have means for carrying the photographic materials which is described in JP-A-60-191257, JP-A-60-191258 and JP-A-191259. As described in JP-A-60-191257, such carrying means can remarkably reduce the amount of a processing solution brought from a preceding bath into a succeeding bath, and has the excellent effect for preventing the characteristics of the processing solution from deteriorating. Such an effect is particularly effective for a reduction in processing time in each stage or a decrease in the replenishment rate of the processing solution.

The color photographic materials of the present invention are usually subjected to washing after desilverization. Stabilization may be conducted instead of washing. In such stabilization, all of the conventional methods described in JP-A-57-8543, JP-A-58-14834 and JP-A-60-220345 can be used. Further, washing-stabilization represented by the treatment of color photographic materials for photography may be carried out, in which a stabilizing bath containing a dye stabilizer and a surfactant is used as the final bath.

Rinsing solutions and stabilizing solutions may contain hard water softeners such as inorganic phosphoric acids, polyaminocarboxylic acids and organic aminophosphonic acids; metal salts such as Mg salts, Al salts and Bi salts; surfactants; and hardeners.

The amount of rinsing water used in the washing stage can be widely established depending on the characteristics of the photographic sensitive materials (for example, depending on materials used such as couplers), the use, the temperature of the rinsing water, the number of rinsing tanks (the number of stages), the replenishing system (countercurrent or cocurrent) and other various conditions. Of these, the relationship between the amount of the rinsing water and the number of the rinsing tanks in the multistage countercurrent system can be determined by the method described in *Journal of the Society of Motion Picture and Television Engineers* 64, 248–253 (May, 1955).

When the amount of the rinsing water is substantially reduced in the multistage countercurrent system, the problem is encountered that bacteria propagate in the water and the resulting suspended matter adheres on the photographic sensitive materials. In order to solve such a problem the method for reducing calcium ions and magnesium ions described in JP-A-62-288838 is very effectively used. There are also used isothiazolone compounds and thiabendazoles described in JP-A-57-8542; chlorine disinfectants such as chlorinated sodium isocyanurate; benzotriazole; and disinfectants described in Hiroshi Horiguchi, *Chemistry of Bacteria Prevention and Fungus Prevention*, Sankyo Shuppan (1986), *Sterilization, Pasteurization and Funqus Prevention Techniques of Microorganisms*, edited by Eisei Gijutsukai, Kogyo Gijutsukai (1982) and *Dictionary of Disinfectants and Fungicides*, edited by Nippon Bohkin Bohbai Gakkai (1986).

The pH of the rinsing water is 4 to 9, and preferably 5 to 8. The temperature of the rinsing water and washing time can also be variously established depending on the characteristics of the photographic materials, the use thereof, and the like. In general, however, a temperature of 15° to 45° C., preferably 25° to 40° C., and a time of 20 seconds to 10 minutes, preferably 30 seconds to 5 minutes, are selected.

The dye stabilizers which can be used for the stabilizing solutions include aldehydes such as formalin and glutaraldehyde, N-methylol compounds, hexamethylenetetramine and adducts of aldehydes and sulfurous acid. The stabilizing solutions may further contain pH adjusting buffers such as boric acid and sodium hydroxide; chelating agents such as 1-hydroxyethylidene, 1-diphosphonic acid and ethylenediaminetetraacetic acid: antisulfurizing agents such as alkanolamine; fluorescent brighteners; and antifungal agents.

Overflowed solutions derived from the above-described washing and/or replenishment of the stabilizing solutions can be recycled in other stages such as the desilverization stage.

When each processing solution is concentrated by evaporation in processing using an automatic processor, it is preferred to add water to correct the concentration.

The color photographic materials of the present invention may contain the color developing agents in order to simplify and expedite processing. It is preferred that various precursors of the color developing agents are added to the photographic materials. Examples of such precursors include indoaniline compounds described in U.S. Pat. No. 3,342,597; Schiff base type compounds described in U.S. Pat. No. 3,342,599, *Research Disclosure*, No.14,850 and ibid., No. 15,159; aldol compounds described in *Research Disclosure*, No. 13,924; metal complexes described in U.S. Pat. No. 3,719,492; and urethane compounds described in JP-A-53-135628.

The color photographic materials of the present invention may contain various 1-phenyl-3-pyrazolidones for the purpose of accelerating color development, if desired. Typical compounds thereof are described in JP-A-56-64339, JP-A-57-144547 and JP-A-58-115438.

Various processing solutions for treating the photographic materials of the present invention are used at a temperature of 10° to 50° C. The standard temperature is usually 33° to 38° C. The temperature may be elevated higher to expedite processing, whereby the processing time can be shortened. On the contrary, the temperature can be decreased to achieve improvements in image qualities and in stability of the processing solutions.

The present invention will be further illustrated in greater detail with reference to the following examples, which are, however, not to be construed as limiting the invention.

EXAMPLE 1

16.1 g of coupler (Y-1) was weighed, and 16.1 g of an organic solvent (dibutyl phthalate (Solv-1)) was added thereto. Further, 24 ml of ethyl acetate was added thereto to dissolve it. The resulting solution was emulsified and dispersed in 200 g of 10 wt% gelatin solution containing 1.5 g of sodium dodecylbenzenesulfonate.

The total amount of the resulting emulsified dispersion was added to 247 g of a silver chlorobromide emulsion (containing 70.0 g/kg of silver and 0.5 mol. % of silver bromide). The mixture was applied to a triacetate film base having a subbing layer so as to give a silver content of 1.73 g/m$^2$, and then, a gelatin layer was formed thereon to obtain a dried film thickness of 1.0 μm as a protecting layer. Thus, sample 101 was prepared. As a gelatin hardener, 1-oxy-3,5-dichloro-s-triazine sodium salt was used.

Samples 102 to 125, 150 to 175 and 200 to 225 were prepared in the same manner as in sample 101, except that the combinations of couplers, dye stabilizers and high boiling point organic solvents as shown in Tables 1 to 3 were used in the above-described emulsified dispersion.

Each sample thus obtained was wedge exposed, and then, processed by the following processing stages.

| Processing Stage | Temperature (°C.) | Time (sec) |
|---|---|---|
| Color Development | 35 | 45 |
| Bleach-Fixing | 30–35 | 45 |
| Rinsing (1) | 30–35 | 20 |
| Rinsing (2) | 30–35 | 20 |
| Rinsing (3) | 30–35 | 20 |
| Drying | 70–80 | 60 |

The composition of each processing solution was as follows.

| | |
|---|---|
| Color Developing Solution: | |
| Water | 800 ml |
| Ethylenediamine-N,N,N,N-tetramethylenephosphonic Acid | 1.5 g |
| Potassium Bromide | 0.015 g |
| Triethanolamine | 8.0 g |
| Sodium Chloride | 1.4 g |
| Potassium Carbonate | 25 g |
| N-Ethyl-N-(β-methanesulfonamidoethyl)-3-methyl-4-aminoaniline Sulfate | 5.0 g |
| N,N-bis(carboxymethyl)hydrazine | 5.5 g |
| Fluorescent Brightener (WHITEX 4B, Sumitomo Chemical Co., Ltd. | 1.0 g |
| Water to make | 1000 ml |
| pH (25° C.) | 10.05 |
| Bleach-Fixing Solution: | |
| Water | 400 ml |
| Ammonium Thiosulfate (700 g/l) | 100 ml |

-continued

| | |
|---|---|
| Sodium Sulfite | 17 g |
| Ethylenediaminetetraacetic Acid Fe(III) Ammonium | 55 g |
| Disodium Ethylenediaminetetraacetate | 5 g |
| Ammonium Bromide | 40 g |
| Water to make | 1000 ml |
| pH (25° C.) | 6.0 |

Rinsing Solution:

Ion-Exchanged water (the content of each of calcium and magnesium being not more than 3 ppm.)

For reach of the samples on which dye images were thus formed, the density (fog) of each color of unexposed portions was measured. The samples were irradiated with a xenon tester (intensity of illumination: 200,000 luxes) equipped with an ultraviolet absorption filter (Fuji Photo Film Co., Ltd.) for screening the light having a wavelength of 400 nm or less for 6 days or 8 days. The rate of residual density to an initial density of 2.0 was determined for each sample. The results obtained are shown in Tables 1 to 3.

TABLE 1

| Sample | Coupler | Color Image Stabilizer | High Boiling Point Solvent | Fog |
|---|---|---|---|---|
| 101 | Y-1 | — | Solv-1 | 0.07 |
| 102 | IY-2 | — | Solv-1 | 0.07 |
| 103 | IY-6 | — | Solv-1 | 0.07 |
| 104 | IY-2 | — | Solv-2 | 0.07 |
| 105 | Y-1 | IA-14 | Solv-1 | 0.07 |
| 106 | Y-1 | IA-21 | Solv-1 | 0.07 |
| 107 | Y-1 | IA-34 | Solv-1 | 0.07 |
| 108 | Y-1 | IA-14 | Solv-2 | 0.07 |
| 109 | Y-1 | Comparative Compound (a) | Solv-1 | 0.08 |
| 110 | Y-1 | Comparative Compound (b) | Solv-1 | 0.09 |
| 111 | Y-1 | — | IO-7 | 0.07 |
| 112 | Y-1 | — | IO-8 | 0.07 |
| 113 | Y-1 | Comparative Compound (c) | Solv-1 | 0.10 |
| 114 | Y-1 | IA-14 | IO-7 | 0.07 |
| 115 | IY-2 | IA-14 | Solv-1 | 0.07 |
| 116 | IY-2 | — | IO-7 | 0.07 |
| 117 | IY-2 | Comparative Compound (b) | IO-7 | 0.08 |
| 118 | IY-2 | IA-14 | IO-7 | 0.07 |
| 119 | Y-1 | IA-12 | Solv-1 | 0.07 |
| 120 | Y-1 | IA-38 | Solv-1 | 0.08 |
| 121 | Y-1 | IA-41 | Solv-1 | 0.07 |
| 122 | Y-1 | IA-45 | Solv-1 | 0.07 |
| 123 | Y-1 | — | IO-22 | 0.07 |
| 124 | Y-1 | — | IO-19 | 0.08 |
| 125 | IY-22 | — | IO-21 | 0.08 |

| Sample | Rate of Residual Yellow Density (%) Initial Density: 2.0 Xe: 200,000 Luxes, for 8 Days | Remark |
|---|---|---|
| 101 | 52 | Comparison |
| 102 | 82 | Invention |
| 103 | 80 | Invention |
| 104 | 83 | Invention |
| 105 | 80 | Invention |
| 106 | 81 | Invention |
| 107 | 82 | Invention |
| 108 | 84 | Invention |
| 109 | 58 | Comparison |
| 110 | 60 | Comparison |
| 111 | 73 | Invention |
| 112 | 75 | Invention |
| 113 | 58 | Comparison |
| 114 | 86 | Invention |
| 115 | 87 | Invention |
| 116 | 82 | Invention |
| 117 | 83 | Invention |
| 118 | 87 | Invention |

TABLE 1-continued

| | | |
|---|---|---|
| 119 | 81 | Invention |
| 120 | 77 | Invention |
| 121 | 78 | Invention |
| 122 | 76 | Invention |
| 123 | 72 | Invention |
| 124 | 70 | Invention |
| 125 | 70 | Invention |

TABLE 2

| Sample | Coupler | Color Image Stabilizer | High Boiling Point Solvent | Fog |
|---|---|---|---|---|
| 150 | M-6 | — | Solv-1 | 0.08 |
| 151 | M-10 | — | Solv-1 | 0.08 |
| 152 | IM-8 | — | Solv-1 | 0.08 |
| 153 | IM-14 | — | Solv-1 | 0.08 |
| 154 | M-6 | IA-1 | Solv-1 | 0.08 |
| 155 | M-6 | IA-13 | Solv-1 | 0.08 |
| 156 | M-6 | IA-34 | Solv-1 | 0.08 |
| 157 | M-10 | — | Solv-2 | 0.08 |
| 158 | M-10 | IA-1 | Solv-2 | 0.08 |
| 159 | M-10 | AI-13 | Solv-2 | 0.08 |
| 160 | M-10 | AI-16 | Solv-2 | 0.08 |
| 161 | M-10 | — | IO-7 | 0.08 |
| 162 | M-10 | — | IO-16 | 0.08 |
| 163 | M-10 | Comparative Compound (c) | Solv-2 | 0.09 |
| 164 | M-10 | Comparative Compound (d) | Solv-1 | 0.08 |
| 165 | M-10 | IA-26 | Solv-1 | 0.08 |
| 166 | M-10 | IA-26 | IO-7 | 0.08 |
| 167 | M-10 | Comparative Compound (d) | IO-7 | 0.08 |
| 168 | IM-14 | — | IO-7 | 0.08 |
| 169 | M-10 | IA-36 | Solv-2 | 0.08 |
| 170 | M-10 | IA-37 | Solv-2 | 0.08 |
| 171 | M-10 | IA-40 | Solv-2 | 0.09 |
| 172 | M-10 | IA-42 | Solv-2 | 0.09 |
| 173 | M-10 | — | IO-18 | 0.10 |
| 174 | M-10 | Comparative Compound (d) | IO-21 | 0.09 |
| 175 | M-13 | Comparative Compound (d) | Solv-2 | 0.09 |

| Sample | Rate of Residual Magenta Density (%) Initial Density: 2.0 Xe: 200,000 Luxes, for 6 Days | Remark |
|---|---|---|
| 150 | 18 | Comparison |
| 151 | 25 | Comparison |
| 152 | 58 | Invention |
| 153 | 70 | Invention |
| 154 | 62 | Invention |
| 155 | 64 | Invention |
| 156 | 63 | Invention |
| 157 | 27 | Comparison |
| 158 | 75 | Invention |
| 159 | 72 | Invention |
| 160 | 73 | Invention |
| 161 | 64 | Invention |
| 162 | 63 | Invention |
| 163 | 40 | Comparison |
| 164 | 56 | Comparison |
| 165 | 75 | Invention |
| 166 | 77 | Invention |
| 167 | 70 | Invention |
| 168 | 74 | Invention |
| 169 | 66 | Invention |
| 170 | 65 | Invention |
| 171 | 67 | Invention |
| 172 | 65 | Invention |
| 173 | 64 | Invention |
| 174 | 75 | Invention |
| 175 | 72 | Invention |

TABLE 3

| Sample | Coupler | Color Image Stabilizer | High Boiling Point Solvent | Fog |
|---|---|---|---|---|
| 200 | C-5 | — | Solv-1 | 0.08 |

TABLE 3-continued

| | | | | |
|---|---|---|---|---|
| 201 | IC-16 | — | Solv-1 | 0.08 |
| 202 | IC-20 | — | Solv-1 | 0.08 |
| 203 | C-5 | Comparative Compound (a) | Solv-1 | 0.08 |
| 204 | C-5 | Comparative Compound (b) | Solv-1 | 0.10 |
| 205 | C-5 | Comparative Compound (c) | Solv-2 | 0.12 |
| 206 | C-5 | Comparative Compound (b) | Solv-2 | 0.10 |
| 207 | C-5 | IA-13 | Solv-2 | 0.08 |
| 208 | C-5 | IA-14 | Solv-2 | 0.08 |
| 209 | C-5 | IA-21 | Solv-1 | 0.08 |
| 210 | C-5 | IA-16 | Solv-1 | 0.08 |
| 211 | C-5 | — | IO-2 | 0.08 |
| 212 | C-5 | — | IO-10 | 0.08 |
| 213 | C-5 | Comparative Compound (c) | Solv-1 | 0.10 |
| 214 | C-5 | IA-13 | IO-10 | 0.08 |
| 215 | C-5 | IA-21 | IO-10 | 0.08 |
| 216 | C-5 | Comparative Compound (a) | IO-10 | 0.09 |
| 217 | IC-16 | IA-14 | IO-7 | 0.08 |
| 218 | C-5 | IA-23 | Solv-2 | 0.08 |
| 219 | C-5 | IA-38 | Solv-2 | 0.09 |
| 220 | C-5 | IA-43 | Solv-2 | 0.09 |
| 221 | C-5 | IA-44 | Solv-2 | 0.09 |
| 222 | C-5 | Comparative Compound (c) | IO-18 | 0.09 |
| 223 | C-5 | — | IO-20 | 0.10 |
| 224 | C-5 | — | IO-24 | 0.08 |
| 225 | IC-30 | — | Solv-2 | 0.08 |

| Sample | Rate of Residual Cyan Density (%) Initial Density: 2.0 Xe: 200,000 Luxes, for 8 Days | Remark |
|---|---|---|
| 200 | 48 | Comparison |
| 201 | 77 | Invention |
| 202 | 75 | Invention |
| 203 | 50 | Comparison |
| 204 | 52 | Comparison |
| 205 | 49 | Comparison |
| 206 | 53 | Comparison |
| 207 | 76 | Invention |
| 208 | 78 | Invention |
| 209 | 74 | Invention |
| 210 | 74 | Invention |
| 211 | 68 | Invention |
| 212 | 62 | Invention |
| 213 | 52 | Comparison |
| 214 | 72 | Invention |
| 215 | 76 | Invention |
| 216 | 70 | Invention |
| 217 | 76 | Invention |
| 218 | 75 | Invention |
| 219 | 70 | Invention |
| 220 | 69 | Invention |
| 221 | 70 | Invention |
| 222 | 67 | Invention |
| 223 | 62 | Invention |
| 224 | 65 | Invention |
| 225 | 70 | Invention |

(Solv-1) High Boiling Point Organic Solvent:

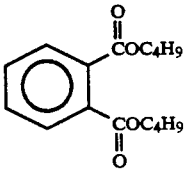

(Solv-2) High Boiling Point Organic Solvent:

-continued

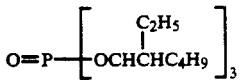

Comparative Compound (a):

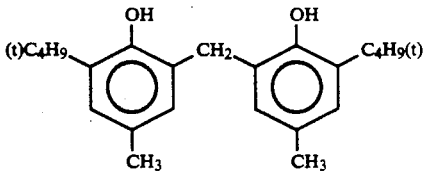

The compound described in JP-B-48-31256

Comparative Compound (b):

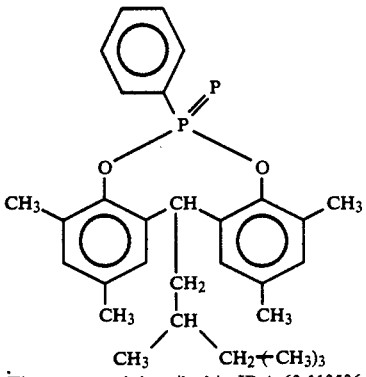

The compound described in JP-A-63-113536

Comparative Compound (c):

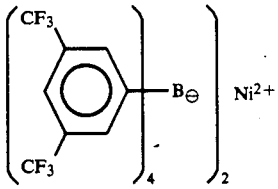

The compound described in JP-A-63-108074

Comparative Compound (d):

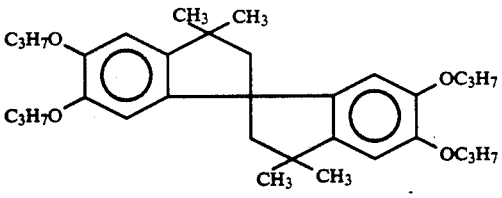

-continued

The compound described in JP-B-62-45545 and JP-A-59-125732

As is apparent from the results of Tables 1 to 3, the couplers of the present invention represented by formula (I), which may be the yellow couplers, the magenta couplers or the cyan couplers, are little in fog generation and significantly excellent in light fastness of developed color images.

When the compounds of the present invention are used as the additives or the high boiling point organic solvents, no fog is produced and the effect of improving the light fastness of developed color images obtained from the couplers is extremely excellent. This effect is remarkably improved, as compared to the samples to which the comparative compounds are added.

EXAMPLE 2

A paper support both sides of which were laminated with polyethylene was coated with the following layers to prepare a sheet of multilayer color photographic paper. Coating solutions were prepared as follows:

Preparation of Coating solution for First Layer 27.2 ml of ethyl acetate, 4.1 g of solvent (Solv-3) and 4.1 g of solvent (Solv-6) were added to 19.1 g of yellow coupler (ExY), 4.4 g of color image stabilizer (Cpd-1) and 1.8 g of color image stabilizer (Cpd-7) to dissolve them. The resulting solution was emulsified and dispersed in 185 ml of 10 wt% gelatin solution containing 8 ml of 10 wt% sodium dodecylbenzenesulfonate to prepare emulsified dispersion A. In the meantime, the following blue-sensitizing dye was added in an amount of $5.0\times10^{-4}$ mol per mol of silver to a silver chlorobromide emulsion sensitized with sulfur to prepare silver chlorobromide emulsion A (a 1:3 mixture (Ag mol ratio) of large-sized emulsion A containing 80.0 mol. % of silver bromide, cubic, 0.85 μm in mean grain size and 0.08 in coefficient of variation, and small-sized emulsion A containing 80.0 mol. % of silver bromide, cubic, 0.62 μm in mean grain size and 0.07 in coefficient of variation). The above-described emulsified dispersion A and this silver chlorobromide emulsion A were mixed with each other to prepare a coating solution for a first layer so as to have the composition shown in the following layer constitution.

Coating solutions for second to seventh layers were prepared by the same manner as in the coating solution for the first layer. As a gelatin hardener for each layer, the sodium salt of 1-oxy-3,5-dichloro-s-triazine was used.

In the silver chlorobromide emulsion of each light-sensitive emulsion layer, the following color sensitizing dyes were used.

Dye for Blue-Sensitive Emulsion Layer:

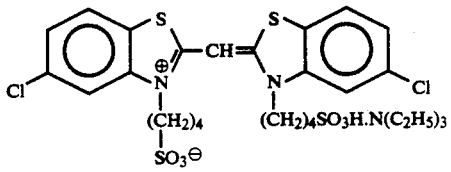

($5.0\times10^{-4}$ mol per mol of silver halide)

Dyes for Green-Sensitive Emulsion Layer:

-continued

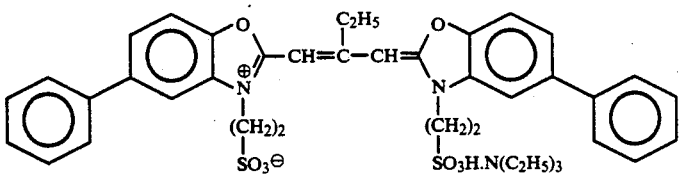

(4.0 × $10^{-4}$ mol per mol of silver halide)

and

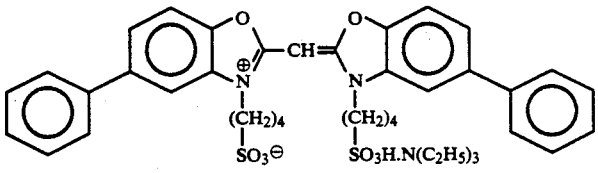

(7.0 × $10^{-5}$ mol per mol of silver halide)

Dye for Red-Sensitive Emulsion Layer:

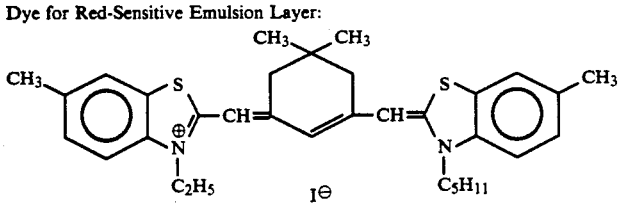

($0.9\times10^{-4}$ mol per mol of silver halide)

To the red-sensitive emulsion layer was added the following compound, in addition to the above-described color sensitizing dye, in an amount of $2.6\times10^{-3}$ mol per mol of silver halide:

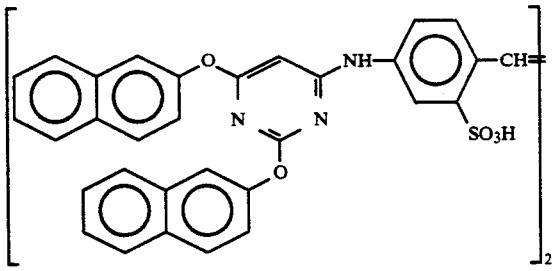

Further, to the blue-sensitive emulsion layer, the green-sensitive emulsion layer and the red-sensitive emulsion layer were added 1-(5-methylureidophenyl)-5-mercaptotetrazole in amounts of $4.0\times10^{-6}$ mol, $3.0\times10^{-5}$ mol and $1.0\times10^{-5}$ mol per mol of silver halide, respectively, and 2-methyl-5-t-octylhydroquinone in amounts of $8\times10^{-3}$, $2\times10^{-2}$ and $2\times10^{-2}$ mol per mol of silver halide, respectively.

Furthermore, 4-hydroxy-6-methyl-1,3,3a,7-tetraazainedene was added to the blue-sensitive emulsion layer and the green-sensitive emulsion layer in amounts of $1.2\times10^{-2}$ mol and $1.1\times10^{-2}$ mol per mol of silver halide, respectively.

Still further, to the red-sensitive emulsion were added the following mercaptoimidazole in an amount of $2\times10^{-4}$ mol per mol of silver halide, and the following mercaptothiadiazole in an amount of $4\times10^{-4}$ mol per mol of silver halide.

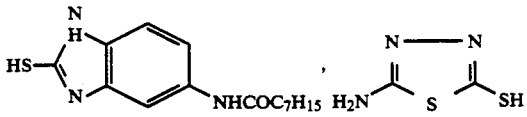

The following dyes were added to the respective emulsion layers for prevention of irradiation:

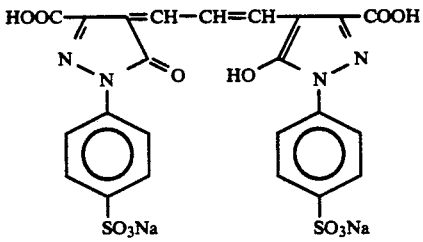

and

-continued

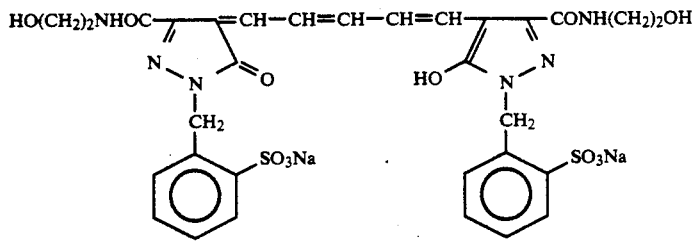

Layer Constitution

The composition of each layer is hereinafter shown. Numerals indicate coated weights (g/m$^2$). For the silver halide emulsions, numerals indicate coated weights converted to silver.

Support

Paper laminated with polyethylene (polyethylene on the side of the first layer containing a white pigment ($TiO_2$) and a bluish dye (ultramarine))

| | |
|---|---|
| First Layer (Blue-Sensitive Emulsion Layer) | |
| Silver Chlorobromide Emulsion Described Above (AgBr: 80 mol %) | 0.26 |
| Gelatin | 1.83 |
| Yellow Coupler (ExY) | 0.83 |
| Color Image Stabilizer 1 (Cpd-1) | 0.19 |
| Color Image Stabilizer 2 (Cpd-7) | 0.08 |
| Solvent 1 (Solv-3) | 0.18 |
| Solvent 2 (Solv-6) | 0.18 |
| Second Layer (Color Mixing Preventing Layer) | |
| Gelatin | 0.99 |
| Color Mixing Inhibitor (Cpd-5) | 0.08 |
| Solvent (Solv-1) | 0.16 |
| Solvent (Solv-4) | 0.08 |
| Third Layer (Green-Sensitive Emulsion Layer) | |
| Silver Chlorobromide Emulsion (a 1:1 mixture (Ag mol ratio) of large-sized emulsion B containing 90 mol % of AgBr, cubic, 0.47 μm in mean grain size and 0.12 in coefficient of variation, and small-sized emulsion B containing 90 mol % of AgBr, cubic, 0.36 μm in mean grain size and 0.09 in coefficient of variation) | 0.16 |
| Gelatin | 1.79 |
| Magenta Coupler (ExM) | 0.32 |
| Color Image Stabilizer 3 (Cpd-2) | 0.02 |
| Color Image Stabilizer 4 (Cpd-3) | 0.20 |
| Color Image Stabilizer 5 (Cpd-4) | 0.01 |
| Color Image Stabilizer (Cpd-8) | 0.03 |
| Color Image Stabilizer (Cpd-9) | 0.04 |
| Solvent 3 (Solv-2) | 0.65 |
| Fourth Layer (Ultraviolet Light Absorbing Layer) | |
| Gelatin | 1.58 |
| Ultraviolet Light Absorber (UV-1) | 0.47 |
| Color Mixing Inhibitor (Cpd-5) | 0.05 |
| Solvent (Solv-5) | 0.24 |
| Fifth Layer (Red-Sensitive Emulsion Layer) | |
| Silver Chlorobromide Emulsion (a 1:2 mixture (Ag mol ratio) of large-sized emulsion C containing 70 mol % of AgBr, cubic, 0.49 μm in mean grain size and 0.08 in coefficient of variation, and small-sized emulsion C containing 70 mol % of AgBr, cubic, 0.34 μm in mean grain size and 0.10 in coefficient of variation) | 0.23 |
| Gelatin | 1.34 |
| Cyan Coupler (ExC) | 0.30 |
| Color Image Stabilizer (Cpd-6) | 0.17 |
| Color Image Stabilizer (Cpd-7) | 0.40 |
| Solvent (Solv-6) | 0.20 |
| Sixth Layer (Ultraviolet Light Absorbing Layer) | |
| Gelatin | 0.53 |
| Ultraviolet Light Absorber (UV-1) | 0.16 |
| Color Mixing Inhibitor (Cpd-5) | 0.02 |
| Solvent (Solv-5) | 0.08 |

-continued
| Seventh Layer (Protective Layer) | |
|---|---|
| Gelatin | 1.33 |
| Acrylic Modified Copolymer of Polyvinyl Alcohol (degree of modification: 17%) | 0.17 |
| Liquid paraffin | 0.03 |
(Cpd-1) Color Image Stabilizer 1:
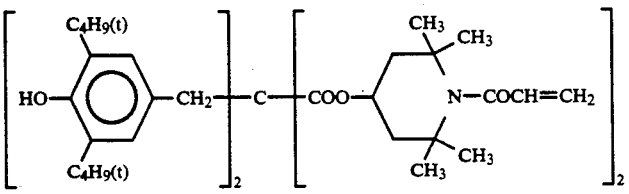
(Cpd-2) Color Image Stabilizer 3:
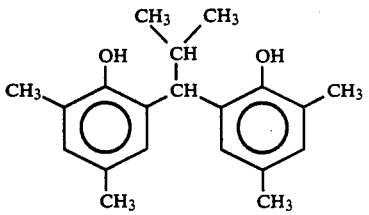
(Cpd-3) Color Image Stabilizer 4:
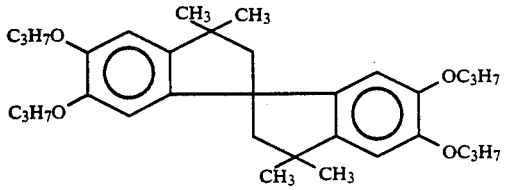
(Cpd-4) Color Image Stabilizer 5:
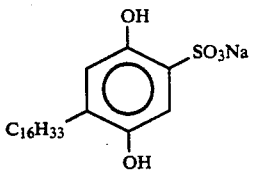
(Cpd-5) Color Mixing Inhibitor:
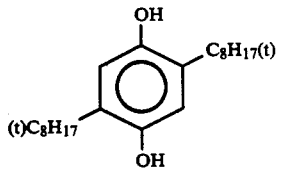
(Cpd-6) Color Image Stabilizer:
A 2:4:4 mixture (weight ratio) of
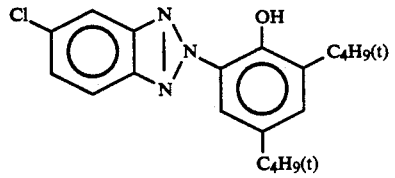

-continued
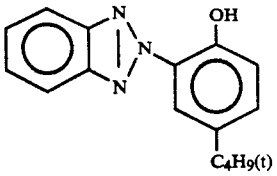
and
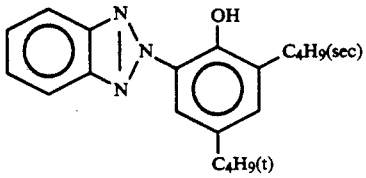
(Cpd-7) Color Image Stabilizer 2:
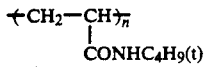
(molecular weight: 80,000)
(Cpd-8) Color Image Stabilizer:
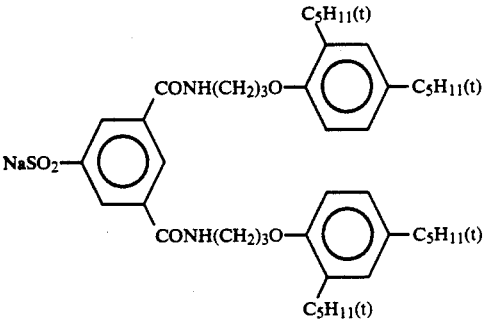
(Cpd-9) Color Image Stabilizer:
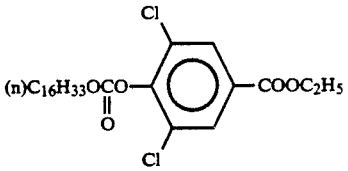
(UV-1) Ultraviolet Light Absorber:
A 4:2:4 mixture (weight ratio) of
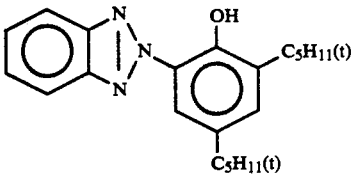
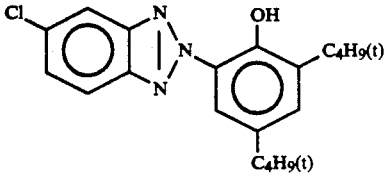
and -continued
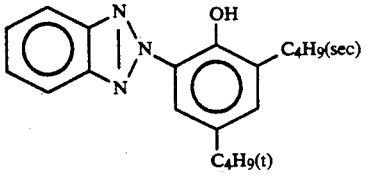
(Solv-1) Solvent:
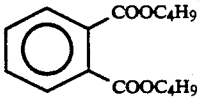
(Solv-2) Solvent 3:
A 2:1 mixture (weight ratio) of
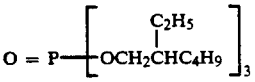
and
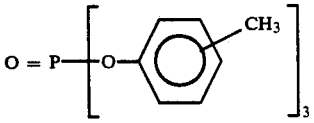
(Solv-3) Solvent 1:
$O = P[O-C_9H_{19}(iso)]_3$
(Solv-4) Solvent:
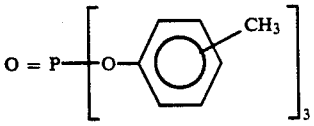
(Solv-5) Solvent:
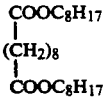
(Solv-6) Solvent 2:
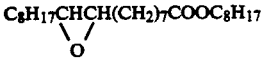
(ExY) Yellow Coupler:
A 1:1 mixture (mol ratio) of
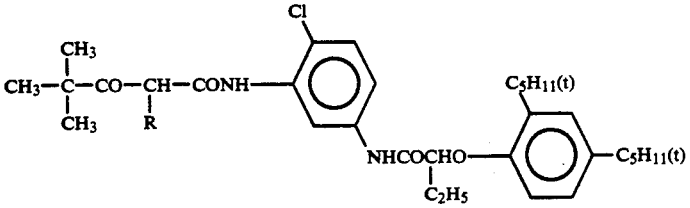

-continued

R =

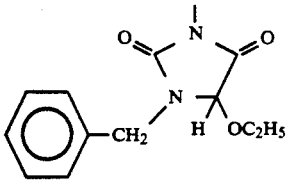

and

R =

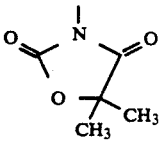

(ExM) Magenta Coupler:
A 1:1 mixture (mol ratio) of

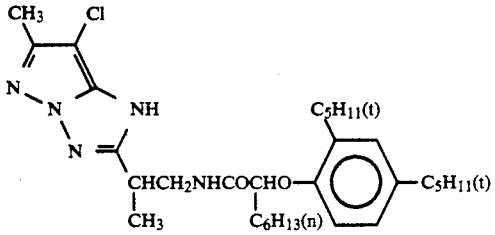

and

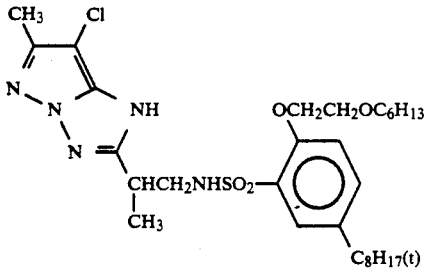

(ExC) Cyan Coupler:
A 1:1 mixture (mol ratio) of

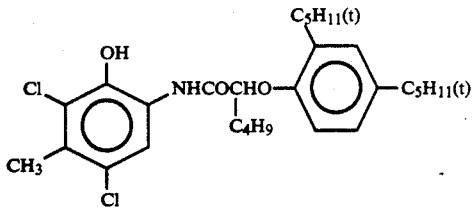

and

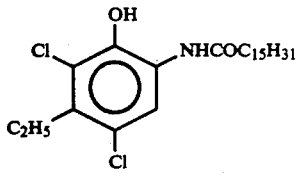

The sample thus obtained was named 1A, and samples 2A to 32A were prepared in the same manner as with sample 1A except that the yellow coupler, color image stabilizer 1, color image stabilizer 2, solvent 1 and solvent 2 contained in the first layer were replaced with the materials as shown in Table 4. Solvent 1 and solvent 2 were replaced with the materials having the same weight as those of sample 1 A and the others were replaced in equimolar amounts.

The comparative compounds are the same as with Example 1.

These samples were subjected to the following photographic processing.

Each of the samples was first subjected to radiation exposure through a three color separating filter for sensitometry by using a sensitometer (Fuji Photo Film Co., Ltd., FWH type, color temperature of light source: 3200° K). The exposure at this time was adjusted so as to amount to 250 CMS when the exposure time was 0.1 second.

The samples to which the exposure was completed were processed with the following processing solutions in the following processing stages using an automatic processor.

| Processing Stage | Temperature (°C.) | Time (min) |
|---|---|---|
| Color Development | 37 | 3.5 |
| Bleach-Fixing | 33 | 1.5 |
| Rinsing | 24–34 | 3 |
| Drying | 70–80 | 1 |

The composition of each processing solution was as follows.

| | |
|---|---|
| Color Developing Solution: | |
| Water | 800 ml |
| Diethylenetriaminepenta-acetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-Ethyl-N-(β-methanesulfonamido-ethyl)-3-methyl-4-aminoaniline sulfate | 4.5 g |
| Hydroxylamine sulfate | 3.0 g |
| Fluorescent brightener (WHITEX 4B, Sumitomo Chemical Co., Ltd.) | 1.0 g |
| Water to make | 1000 ml |
| pH (25° C.) | 10.25 |
| Bleach-Fixing Solution | |
| Water | 400 ml |
| Ammonium thiosulfate (700 g/l) | 150 ml |
| Sodium sulfite | 18 g |
| Ethylenediaminetetraacetic acid Fe(III) ammonium | 55 g |
| Disodium ethylenediaminetetraacetate | 5 g |
| Water to make | 1000 ml |
| pH (25° C.) | 6.70 |

For each of the samples on which dye images were thus formed the photographic characteristics were examined and the fading test was conducted. The photographic characteristics were evaluated by the density (fog) of yellow color of unexposed portions. The effect of preventing fading was shown by the rate of residual yellow density to an initial density of 2.0 after the samples were irradiated with a xenon tester (intensity of illumination: 200,000 luxes) for 200 hours.

The results obtained are shown in Table 4.

TABLE 4

| Sample | Yellow Coupler | Color Image Stabilizer 1 | Color Stabilizer 2 | Solvent 1 | Solvent 2 |
|---|---|---|---|---|---|
| 1A | EXY | Cpd-1 | Cpd-7 | Solv-3 | Solv-6 |
| 2A | Y-2 | Cpd-1 | Cpd-7 | Solv-3 | Solv-6 |
| 3A | Y-7 | Cpd-1 | Cpd-7 | Solv-3 | Solv-6 |
| 4A | IY-2 | Cpd-1 | Cpd-7 | Solv-3 | Solv-6 |
| 5A | IY-4 | Cpd-1 | Cpd-7 | Solv-3 | Solv-6 |
| 6A | IY-5 | Cpd-1 | Cpd-7 | Solv-3 | Solv-6 |
| 7A | IY-6 | Cpd-1 | Cpd-7 | Solv-3 | Solv-6 |
| 8A | EXY | Comparative Compound (c) | — | Solv-3 | Solv-6 |
| 9A | EXY | Comparative Compound (b) | — | Solv-3 | Solv-6 |
| 10A | EXY | IA-1 | — | Solv-3 | Solv-6 |
| 11A | EXY | IA-14 | — | Solv-3 | Solv-6 |
| 12A | EXY | IA-16 | — | Solv-3 | Solv-6 |
| 13A | EXY | IA-21 | — | Solv-3 | Solv-6 |
| 14A | EXY | IA-23 | — | Solv-3 | Solv-6 |
| 15A | EXY | IA-23 | Cpd-7 | Solv-3 | Solv-6 |
| 16A | EXY | IA-14 | Cpd-7 | Solv-3 | Solv-6 |
| 17A | Y-7 | Comparative Compound (c) | — | Solv-3 | Solv-6 |
| 18A | Y-7 | Comparative Compound (b) | — | Solv-3 | Solv-6 |
| 19A | Y-7 | IA-14 | — | Solv-3 | Solv-6 |
| 20A | Y-7 | IA-16 | — | Solv-3 | Solv-6 |
| 21A | Y-7 | IA-21 | Cpd-7 | Solv-3 | Solv-6 |
| 22A | EXY | Cpd-1 | Cpd-7 | IO-2 | Solv-6 |
| 23A | EXY | Cpd-1 | Cpd-7 | IO-14 | Solv-6 |
| 24A | EXY | Cpd-1 | Cpd-7 | IO-7 | Solv-6 |
| 25A | EXY | Cpd-1 | Cpd-7 | Solv-3 | IO-11 |
| 26A | EXY | Cpd-1 | Cpd-7 | IO-7 | IO-7 |
| 27A | EXY | Cpd-1 | Cpd-7 | Solv-3 | Solv-3 |
| 28A | EXY | IA-14 | Cpd-7 | IO-7 | Solv-6 |
| 29A | EXY | Cpd-1 | Cpd-7 | Solv-3 | Solv-6 |
| 30A | Y-7 | Cpd-1 | Cpd-7 | Solv-3 | Solv-6 |
| 31A | Y-7 | Cpd-1 | Cpd-7 | IO-14 | Solv-6 |
| 32A | Y-7 | Cpd-1 | Cpd-7 | IO-7 | Solv-6 |

| Sample | Fog | Rate of Residual Yellow Density (%) Initial Density: 2.0 Xe: 200,000 Luxes, 200 hours | Remark |
|---|---|---|---|
| 1A | 0.07 | 60 | Comparison |
| 2A | 0.07 | 58 | Comparison |
| 3A | 0.08 | 60 | Comparison |
| 4A | 0.08 | 82 | Invention |
| 5A | 0.07 | 83 | Invention |
| 6A | 0.07 | 81 | Invention |
| 7A | 0.07 | 83 | Invention |
| 8A | 0.09 | 58 | Comparison |
| 9A | 0.08 | 62 | Comparison |
| 10A | 0.07 | 80 | Invention |
| 11A | 0.07 | 82 | Invention |
| 12A | 0.07 | 83 | Invention |
| 13A | 0.07 | 80 | Invention |
| 14A | 0.07 | 80 | Invention |
| 15A | 0.08 | 82 | Invention |
| 16A | 0.07 | 84 | Invention |
| 17A | 0.10 | 59 | Comparison |
| 18A | 0.08 | 64 | Comparison |
| 19A | 0.08 | 82 | Invention |
| 20A | 0.08 | 80 | Invention |
| 21A | 0.08 | 82 | Invention |
| 22A | 0.07 | 80 | Invention |
| 23A | 0.07 | 77 | Invention |
| 24A | 0.07 | 81 | Invention |
| 25A | 0.07 | 82 | Invention |
| 26A | 0.07 | 80 | Invention |
| 27A | 0.07 | 65 | Comparison |
| 28A | 0.07 | 85 | Invention |
| 29A | 0.07 | 68 | Comparison |
| 30A | 0.08 | 65 | Comparison |
| 31A | 0.08 | 77 | Invention |
| 32A | 0.08 | 80 | Invention |

As is apparent from the results of Table 4, the couplers of the present invention in which boron are incorporated in their molecules are little in fog generation and significantly excellent in light fastness of developed color images.

When the compounds of the present invention is used as the additives, no fog is produced and the effect of improving the light fastness of developed color images obtained from the couplers is extremely excellent. These results show that this effect is remarkably excellent, as compared to the samples to which the comparative compounds are added. The light fastness of developed color images are more improved by the addition of supplementary Cpd-7.

When the compounds of the present invention are used as the high boiling point organic solvents, no fog is produced and the effect of improving the light fastness of developed color images obtained from the couplers is extremely excellent.

EXAMPLE 3

Samples 2B to 21B were prepared in the same manner as in sample 1A obtained in Example 2, except that the magenta coupler, color image stabilizer 3, and solvent 3 contained in the third layer were replaced with the materials as shown in Table 5. Solvent 3 was replaced with the materials having the same weight as that of sample 1A, and the others were replaced in equimolar amounts.

These samples were subjected to the same photographic processing as with Example 2.

For each of the samples on which dye images were thus formed, the fading test was conducted. The effect of preventing fading was evaluated by the rate of residual magenta density to an initial density of 1.0 after the samples were irradiated with a xenon tester (intensity of illumination: 200,000 luxes) for 10 days.

The comparative compound is the same as with Example 1.

The results obtained are shown in Table 5.

TABLE 5

| Sample | Magenta Coupler | Color Image Stabilizer 3 | Solvent 1 |
|---|---|---|---|
| 1A | EXM | Cpd-2 | Solv-2 |
| 2B | IM-10 | Cpd-2 | Solv-2 |
| 3B | IM-12 | Cpd-2 | Solv-2 |
| 4B | EXM | — | Solv-2 |
| 5B | IM-10 | — | Solv-2 |
| 6B | IM-12 | — | Solv-2 |
| 7B | EXM | — | Solv-3 |
| 8B | IM-14 | — | Solv-3 |
| 9B | EXM | Comparative Compound(c) | Solv-2 |
| 10B | EXM | IA-14 | Solv-2 |
| 11B | EXM | IA-26 | Solv-2 |
| 12B | EXM | IA-1 | Solv-2 |
| 13B | EXM | IA-21 | Solv-2 |
| 14B | EXM | — | IO-6 |
| 15B | EXM | — | IO-7 |
| 16B | EXM | — | IO-14 |
| 17B | EXM | — | IO-16 |
| 18B | EXM | Cpd-2 | IO-7 |
| 19B | EXM | Cpd-2 | IO-14 |
| 20B | EXM | Cpd-2 | IO-16 |
| 21B | EXM | — | IO-7/Solv-2 = 1/1 |

| Sample | Rate of Residual Magenta Density (%) Initial Density: 2.0 Xe: 200,000 Luxes, for 8 Days | Remark |
|---|---|---|
| 1A | 73 | Comparison |
| 2B | 80 | Invention |
| 3B | 80 | Invention |
| 4B | 60 | Comparison |
| 5B | 79 | Invention |
| 6B | 80 | Invention |
| 7B | 53 | Comparison |
| 8B | 79 | Invention |
| 9B | 65 | Comparison |
| 10B | 80 | Invention |
| 11B | 82 | Invention |
| 12B | 81 | Invention |
| 13B | 83 | Invention |
| 14B | 77 | Invention |
| 15B | 82 | Invention |
| 16B | 75 | Invention |
| 17B | 83 | Invention |
| 18B | 80 | Invention |
| 19B | 77 | Invention |
| 20B | 81 | Invention |
| 21B | 77 | Invention |

As is apparent from the results of Table 5, the couplers of the present invention in which boron is incorporated in their molecules and the samples to which the compounds of the present invention are added as the additives are significantly excellent in light fastness of developed color images obtained form the couplers. This effect is remarkably excellent, as compared to the samples to which the comparative compounds having similar structures are added.

When the compounds of the present invention are used as the high boiling point organic solvents, the effect of improving the light fastness of developed color images obtained from the couplers is excellent. In particular, when Cpd-2 is not added, this effect is remarkably improved.

EXAMPLE 4

A paper support both sides of which were laminated with polyethylene was coated with the following layers to prepare a sheet of multilayer color photographic paper. Coating solutions were prepared as follows:

Preparation of Coating solution for First Layer 27.2 ml of ethyl acetate and 8.2 g of solvent (Solv-1) were added to 19.1 g of yellow coupler (ExY), 4.4 g of color image stabilizer (Cpd-1) and 0.7 g of color image stabilizer (Cpd-7) to dissolve them. The resulting solution was emulsified and dispersed in 185 ml of 10 wt. % gelatin solution containing 8 ml of 10 wt. % sodium dodecylbenzenesulfonate to prepare emulsified dispersion A. In the meantime, each of the following blue-sensitizing dyes A and B was added, in an amount of $2.0\times10^{-4}$ mol per mol of silver for a large-sized emulsion and in an amount of $2.5\times10^{-4}$ mol per mol of silver for a small-sized emulsion, to a silver chlorobromide emulsion, followed by sensitization with sulfur to prepare silver chlorobromide emulsion A (cubic, a 3:7 mixture (Ag mol ratio) of large-sized emulsion A having 0.88 μm in mean grain size and small-sized emulsion A having 0.70 μm in mean grain size, the coefficient of variation in grain size distribution for the respective emulsions being 0.08 and 0.10, each emulsion containing 0.2 mol. % of silver bromide localized on the surfaces of grains). The above-described emulsified dispersion A and this silver chlorobromide emulsion A were mixed with each other to prepare a coating solution for a first layer so as to have the composition shown in the following layer constitution.

Coating solutions for second to seventh layers were prepared similarly with the coating solution for the first layer. As a gelatin hardener for each layer, the sodium salt of 1-oxy-3,5-dichloro-s-triazine was used.

In the silver chlorobromide emulsion of each light-sensitive emulsion layer, the following color sensitizing dyes were used.

Sensitizing Dye A for Blue-Sensitive Emulsion Layer:

-continued

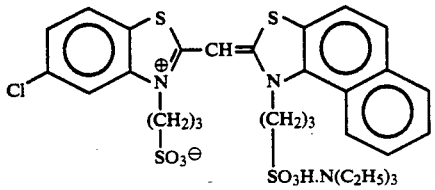

Sensitizing Dye B for Blue-Sensitive Layer:

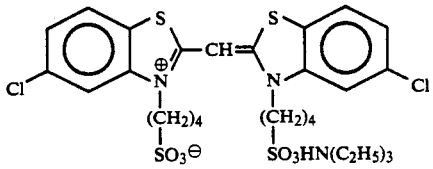

($2.0\times10^{-4}$ mol per mol of silver halide, respectively, for a large-sized emulsion A, and $2.5\times10^{-4}$ mol per mol of silver halide, respectively, for a small-sized emulsion A)

Sensitizing Dye C for Green-Sensitive Emulsion Layer:

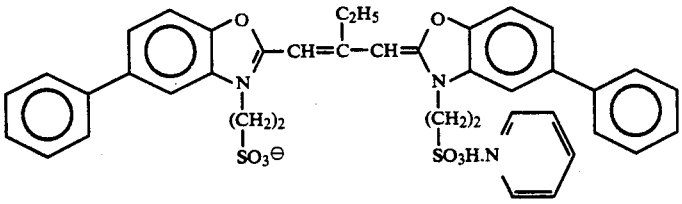

($4.0\times10^{-4}$ mol per mol of silver halide, respectively, for a large-sized emulsion B, and $5.6\times10^{-4}$ mol per mol of silver halide, respectively, for a small-sized emulsion B)

Sensitizing Dye D for Green-Sensitive Emulsion Layer:

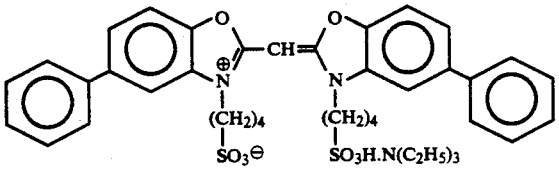

($7.0\times10^{-5}$ mol per mol of silver halide, respectively, for a large-sized emulsion B, and $1.0\times10^{-3}$ mol per mol of silver halide, respectively, for a small-sized emulsion B)

Sensitizing Dye E for Red-Sensitive Emulsion Layer:

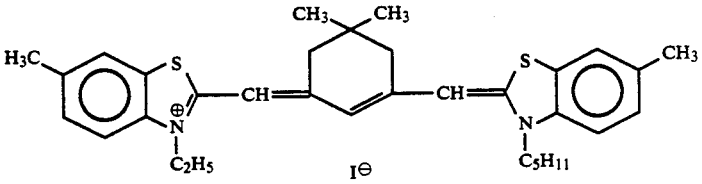

($0.9\times10^{-4}$ mol per mol of silver halide, respectively, for a large-sized emulsion C, and $1.1\times10^{-4}$ mol per mol of silver halide, respectively, for a small-sized emulsion C)

To the red-sensitive emulsion layer was added the following compound in an amount of $2.6\times10^{-3}$ mol per mol of silver halide:

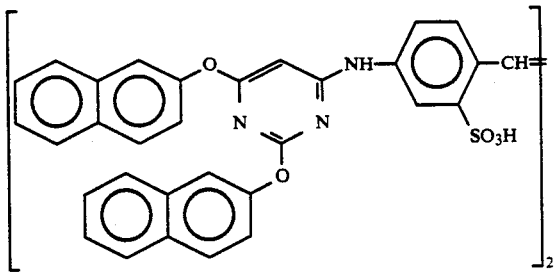

Further, to the blue-sensitive emulsion layer, the green-sensitive emulsion layer and the red-sensitive emulsion layer was added 1-(5-methylureidophenyl)-5-mercaptotetrazole in amounts of $8.5\times10^{-5}$ mol, $7.7\times10^{-4}$ mol and $2.5\times10^{-4}$ mol per mol of silver halide, respectively.

Furthermore, 4-hydroxy-6-methyl-1,3,3a,7-tetraazainedene was added to the blue-sensitive emulsion layer and the green-sensitive emulsion layer in amounts of $1\times10^{-4}$ mol and $2\times10^{-4}$ mol per mol of silver halide, respectively.

Still further, the following dyes were added to the respective emulsion layers for prevention of irradiation:

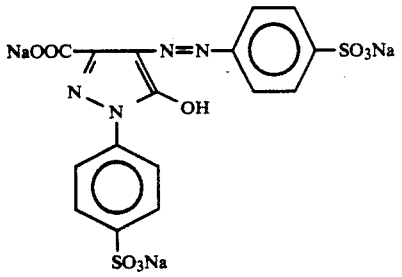

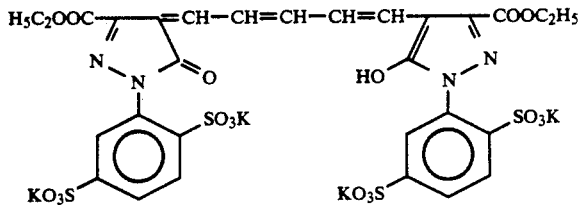

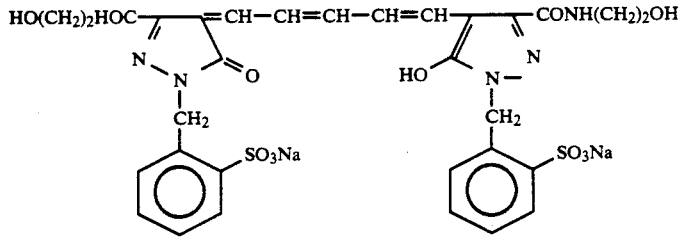

Layer Constitution

The composition of each layer is hereinafter shown. Numerals indicate coated weights (g/m$^2$). For the silver halide emulsions, numerals indicate coated weights converted to silver.

Support

Paper laminated with polyethylene (polyethylene on the side of the first layer containing a white pigment ($TiO_2$) and a bluish dye (ultramarine))

| | |
|---|---|
| First Layer (Blue-Sensitive Emulsion Layer) | |
| Silver Chlorobromide Emulsion Described Above | 0.30 |
| Gelatin | 1.86 |
| Yellow Coupler (ExY) | 0.82 |
| Color Image Stabilizer (Cpd-1) | 0.19 |
| Solvent (Solv-1) | 0.35 |
| Color Image Stabilizer (Cpd-7) | 0.06 |
| Second Layer (Color Mixing Preventing Layer) | |
| Gelatin | 0.99 |
| Color Mixing Inhibitor (Cpd-5) | 0.08 |
| Solvent (Solv-1) | 0.16 |
| Solvent (Solv-4) | 0.08 |
| Third Layer (Green-Sensitive Emulsion Layer) | |
| Silver Chlorobromide Emulsion (cubic, a 1:3 mixture (Ag mol ratio) of large-sized emulsion B, 0.55 μm in mean grain size and small-sized emulsion B, 0.39 mm in mean grain size, the coefficient of variation in grain size distribution for the respective emulsions being 0.10 and 0.08, each emulsion containing 0.8 mol % of silver bromide localized on the surfaces of grains) | 0.12 |
| Gelatin | 1.24 |
| Magenta Coupler (ExM) | 0.20 |
| Color Image Stabilizer (Cpd-2) | 0.03 |
| Color Image Stabilizer (Cpd-3) | 0.15 |
| Color Image Stabilizer (Cpd-4) | 0.02 |
| Color Image Stabilizer (Cpd-9) | 0.02 |
| Solvent 3 (Solv-2) | 0.40 |
| Fourth Layer (Ultraviolet Light Absorbing Layer) | |
| Gelatin | 1.58 |
| Ultraviolet Light Absorber (UV-1) | 0.47 |

-continued

| | |
|---|---|
| Color Mixing Inhibitor (Cpd-5) | 0.05 |
| Solvent (Solv-5) | 0.24 |
| Fifth Layer (Red-Sensitive Emulsion Layer) | |
| Silver Chlorobromide Emulsion (cubic, a 1:4 mixture (Ag mol ratio) of large-sized emulsion C, 0.58 μm in mean grain size and small-sized emulsion C, 0.45 μm in mean grain size, the coefficient of variation in grain size distribution for the respective emulsions being 0.09 and 0.11, each emulsion containing 0.6 mol % of silver bromide localized on the surfaces of grains) | 0.23 |
| Gelatin | 1.34 |
| Cyan Coupler (ExC) | 0.32 |
| Color Image Stabilizer (Cpd-6) | 0.17 |
| Color Image Stabilizer 7 (Cpd-7) | 0.40 |
| Color Image Stabilizer 8 (Cpd-8) | 0.04 |
| Solvent 4 (Solv-6) | 0.15 |
| Sixth Layer (Ultraviolet Light Absorbing Layer) | |
| Gelatin | 0.53 |
| Ultraviolet Light Absorber (UV-1) | 0.16 |
| Color Mixing Inhibitor (Cpd-5) | 0.02 |
| Solvent (Solv-5) | 0.08 |
| Seventh Layer (Protective Layer) | |
| Gelatin | 1.33 |
| Acrylic Modified Copolymer of Polyvinyl Alcohol (degree of modification: 17%) | 0.17 |
| Liquid paraffin | 0.03 |

(ExY) Yellow Coupler:
A 1:1 mixture (mol ratio) of

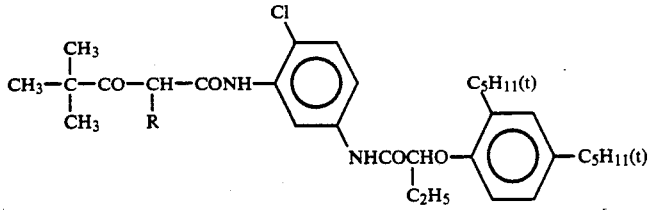

R =

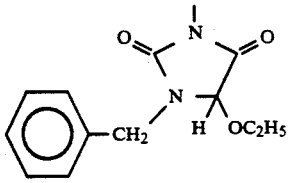

and

R =

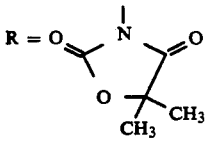

(ExM) Magenta Coupler:
A 1:1 mixture (mol ratio) of

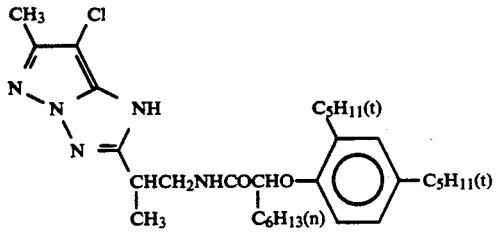

and

-continued
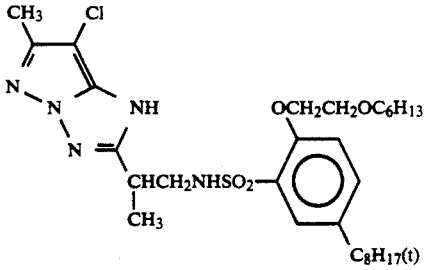
(ExC) Cyan Coupler:
A 2:4:4 mixture (mol ratio) of
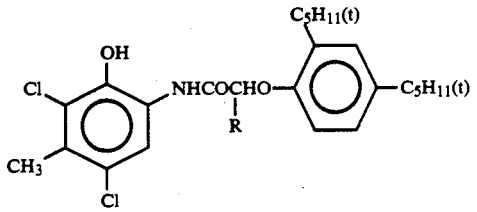
R = $C_2H_5$ and $C_4H_9$
and
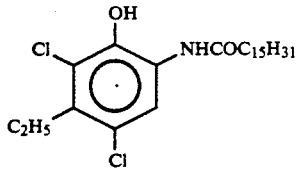
(Cpd-1) Color Image Stabilizer:
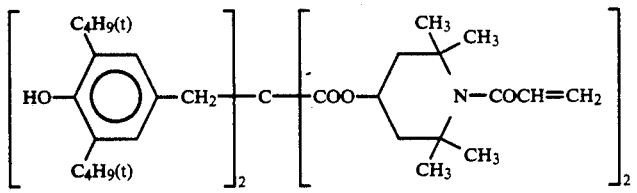
(Cpd-2) Color Image Stabilizer:
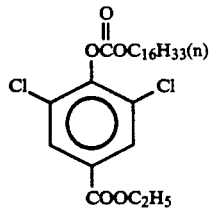
(Cpd-3) Color Image Stabilizer:
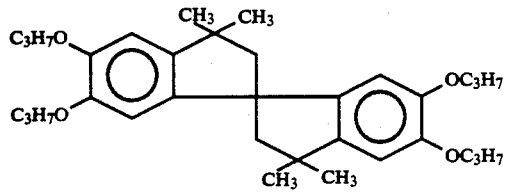
(Cpd-4) Color Image Stabilizer:

-continued
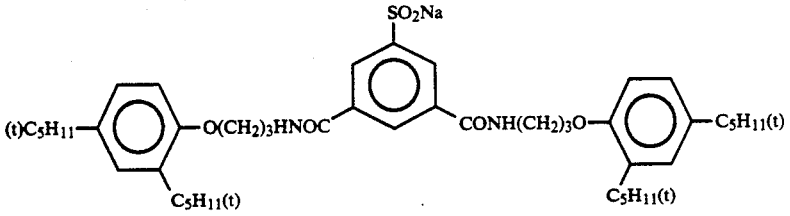
(Cpd-5) Color Mixing Inhibitor:
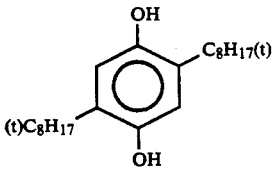
(Cpd-6) Color Image Stabilizer:
A 2:4:4 mixture (weight ratio) of
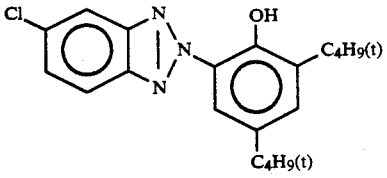
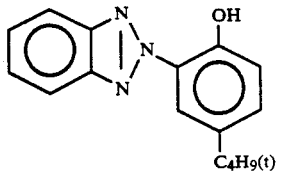
and
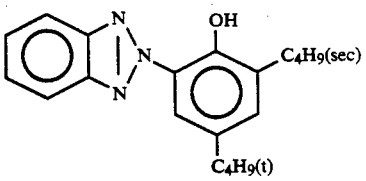
(Cpd-7) Color Image Stabilizer 7:
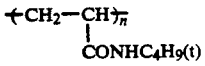
(molecular weight: 60,000)
(Cpd-8) Color Image Stabilizer 8:
A 1:1 mixture of R = $C_{16}H_{33}$ (sec) and R = $C_{14}H_{29}$ (sec)
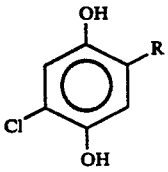
(Cpd-9) Color Image Stabilizer:

-continued
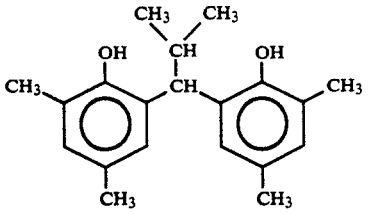
(UV-1) Ultraviolet Light Absorber:
A 4:2:4 mixture (weight ratio) of
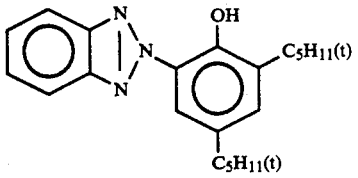
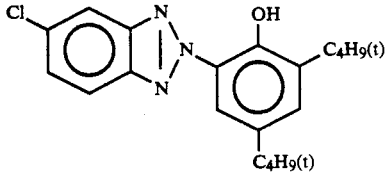
and
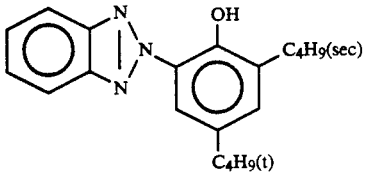
(Solv-1) Solvent:
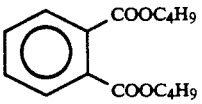
(Solv-2) Solvent:
A 2:1 mixture (volume ratio) of
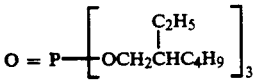
and
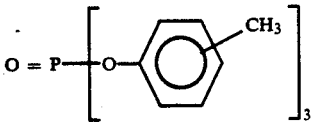
(Solv-4) Solvent:
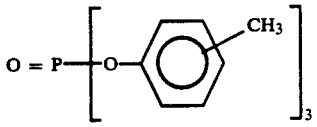
(Solv-5) Solvent:

-continued $COOC_8H_{17}$
|
$(CH_2)_8$
|
$COOC_8H_{17}$ (Solv-6) Solvent:

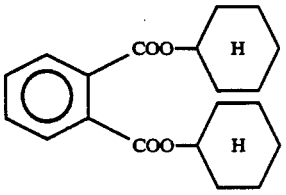

The sample thus obtained was named 1C, and samples 2C to 32C were prepared in the same manner as with sample 1C except that the cyan coupler, color image stabilizer 7 and solvent 4 contained in the fifth layer were replaced with the materials as shown in Table 6. The cyan coupler was replaced in an equimolar amount, color image stabilizer 7 was added in an amount of 50 mol. % based on the cyan coupler, and solvent 4 was replaced in the same weight.

The comparative compounds are the same as with Example 1.

These samples were subjected to the following photographic processing.

Each of the samples was first subjected to radiation exposure in accordance with the method described in Example 2. With respect to the samples to which the exposure was completed, continuous processing (running test) was carried out according to the following processing stages using a paper processor until the replenishment rate of the processing solutions reached two times the tank capacity of the color development.

| Processing Stage | Temperature (°C.) | Time (sec) | Replenisher* (ml) | Tank Capacity (liter) |
|---|---|---|---|---|
| Color Development | 35 | 45 | 161 | 17 |
| Bleach-Fixing | 30–35 | 45 | 215 | 17 |
| Rinsing (1) | 30–35 | 20 | — | 10 |
| Rinsing (2) | 30–35 | 20 | — | 10 |
| Rinsing (3) | 30–35 | 20 | 350 | 10 |
| Drying | 70–80 | 60 | — | — |

*Replenishment rate: "ml" per $m^2$ of light-sensitive material (Three tank countercurrent system from rinsing (3) to rinsing (1) was employed.)

The composition of each processing solution was as follows.

| | Tank Solution | Replenisher |
|---|---|---|
| Color Developing Solution | | |
| Water | 800 ml | 800 ml |
| Ethylenediamine-N,N,N,N-tetramethylenephosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-Bis(carboxymethyl)-hydrazine | 5.5 g | 7.0 g |
| Fluorescent brightener (WHITEX 4B, Sumitomo Chemical Co., Ltd.) | 1.0 g | 2.0 g |
| Water to make | 1000 ml | 1000 ml |
| pH (25° C.) | 10.05 | 10.45 |
| Bleach-Fixing Solution(tank solution and replenisher being the same) | | |
| Water | | 400 ml |
| Ammonium Thiosulfate (700 g/ml) | | 100 ml |
| Sodium Sulfite | | 17 g |
| Ethylenediaminetetraacetic Acid Fe(III) Ammonium | | 55 g |
| Disodium Ethylenediaminetetraacetate | | 5 g |
| Ammonium Bromide | | 40 g |
| Water to make | | 1000 ml |
| pH (25° C.) | | 6.0 |

Rinsing Solution (tank solution and replenisher being the same)

Ion-Exchanged Water (the content of each of calcium and magnesium being not more than 3 ppm).

For each of the final samples thus obtained by the continuous processing, the fading test was conducted. The effect of preventing fading was evaluated by the rate of residual cyan density to an initial density of 2.0 after the samples were irradiated with a xenon tester (intensity of illumination: 100,000 luxes) for 12 days.

The results obtained are shown in Table 6.

TABLE 6

| Sample | Color Image Cyan Coupler | Stabilizer 7 | Solvent 4 |
|---|---|---|---|
| 1C | EXC | Cpd-7 | Solv-6 |
| 2C | Comparative Coupler (a) | Cpd-7 | Solv-6 |
| 3C | IC-16 | Cpd-7 | Solv-6 |
| 4C | IC-18 (½ mol) | Cpd-7 | Solv-6 |
| 5C | IC-20 | Cpd-7 | Solv-6 |
| 6C | EXC | — | Solv-6 |
| 7C | Comparative Coupler (a) | — | Solv-6 |
| 8C | IC-16 | — | Solv-6 |
| 9C | IC-20 | — | Solv-6 |
| 10C | EXC | IA-5 | Solv-6 |
| 11C | EXC | IA-15 | Solv-6 |
| 12C | EXC | IA-21 | Solv-6 |
| 13C | EXC | IA-23 | Solv-6 |
| 14C | EXC | IA-29 | Solv-6 |
| 15C | EXC | IA-33 | Solv-6 |
| 16C | EXC | IA-34 | Solv-6 |
| 17C | EXC | Comparative Compound (a) | Solv-6 |
| 18C | EXC | Comparative | Solv-6 |

TABLE 6-continued

| | | | |
|---|---|---|---|
| 19C | C-10 | Compound (c) Comparative Compound (c) | Solv-6 |
| 20C | C-10 | — | Solv-6 |
| 21C | C-10 | IA-5 | Solv-6 |
| 22C | C-10 | IA-15 | Solv-6 |
| 23C | C-10 | IA-21 | Solv-6 |
| 24C | C-10 | IA-33 | Solv-6 |
| 25C | EXC | — | IO-7 |
| 26C | EXC | Cpd-7 | IO-7 |
| 27C | EXC | Cpd-7 | IO-8 |
| 28C | EXC | — | IO-8 |
| 29C | EXC | — | Solv-4 |
| 30C | C-10 | — | IO-7 |
| 31C | C-10 | — | IO-8 |
| 32C | C-10 | IA-15 | IO-16 |

| Sample | Rate of Residual Cyan Density (%) Initial Density: 2.0 Xe: 200,000 Luxes, for 12 Days | Remark |
|---|---|---|
| 1C | 64 | Comparison |
| 2C | 66 | Comparison |
| 3C | 79 | Invention |
| 4C | 78 | Invention |
| 5C | 78 | Invention |
| 6C | 62 | Comparison |
| 7C | 65 | Comparison |
| 8C | 79 | Invention |
| 9C | 78 | Invention |
| 10C | 78 | Invention |
| 11C | 80 | Invention |
| 12C | 78 | Invention |
| 13C | 77 | Invention |
| 14C | 77 | Invention |
| 15C | 80 | Invention |
| 16C | 79 | Invention |
| 17C | 67 | Comparison |
| 18C | 67 | Comparison |
| 19C | 58 | Comparison |
| 20C | 51 | Comparison |
| 21C | 74 | Invention |
| 22C | 75 | Invention |
| 23C | 77 | Invention |
| 24C | 77 | Invention |
| 25C | 72 | Invention |
| 26C | 75 | Invention |
| 27C | 74 | Invention |
| 28C | 72 | Invention |
| 29C | 63 | Comparison |
| 30C | 74 | Invention |
| 31C | 73 | Invention |
| 32C | 78 | Invention |

Comparative Coupler (a)

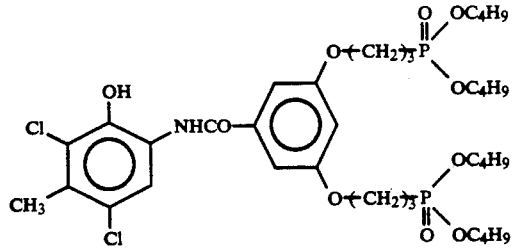

The coupler described in U.S. Pat. No. 4,026,709.

As is apparent from the results of Table 6, even when boron is incorporated in the molecules of the couplers or even when the compounds of the present invention are added as the additives or as the high boiling point organic solvents, the samples of the present invention are significantly excellent in the effect of improving the light fastness as with the yellow dye images in Examples 1 and 2 or the magenta dye images in Example 3, and superior to conventional and similar couplers or compounds.

EXAMPLE 5

Each coated sample prepared in Example 3 was subjected to exposure by the method described in Example 3. With respect to the samples in which the above-described photographic materials were otherwise subjected to imagewise exposure, continuous processing (running test) was carried out according to the following processing stages using a paper processor until the replenishment rate of the processing solutions reached two times the tank capacity of the color development, followed by processing to obtain color images.

| Processing Stage | Temperature (°C.) | Time (sec) | Replenisher* (ml) | Tank Capacity (liter) |
|---|---|---|---|---|
| Color Development | 35 | 45 | 161 | 17 |
| Bleach-Fixing | 30–36 | 45 | 215 | 17 |
| Stabilization (1) | 30–37 | 20 | — | 10 |
| Stabilization (2) | 30–37 | 20 | — | 10 |
| Stabilization (3) | 30–37 | 20 | — | 10 |
| Stabilization (4) | 30–37 | 30 | 248 | 10 |
| Drying | 70–85 | 60 | — | — |

*Replenishment rate: "ml" per $m^2$ of light-sensitive material (Four tank countercurrent system from rinsing (4) to rinsing (1) was employed.)

The composition of each processing solution was as follows.

| | Tank Solution | Replenisher |
|---|---|---|
| Color Developing Solution | | |
| Water | 800 ml | 800 ml |
| Ethylenediaminetetraacetic Acid | 2.0 g | 2.0 g |
| 1-Hydroxyethylidene-1,1-diphosphonic Acid | 0.3 g | 0.3 g |
| Triethanolamine | 8.0 g | 8.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| Diethylhydroxyethylamine | 4.2 g | 6.0 g |
| Fluorescent brightener (4,4'-diaminostilbene) | 2.0 g | 2.5 g |
| Water to make | 1000 ml | 1000 ml |
| pH (25° C.) | 10.05 | 10.45 |
| Bleaching-Fixing Solution (tank solution and replenisher the same) | | |
| Water | | 400 ml |
| Ammonium Thiosulfate (700 g/ml) | | 100 ml |
| Sodium Sulfite | | 17 g |
| Ethylenediaminetetraacetic Acid Fe(III) Ammonium | | 55 g |
| Disodium Ethylenediaminetetraacetate | | 5 g |
| Glacial Acetic Acid | | 9 g |
| Water to make | 1000 ml | |
| pH (25° C.) | 5.40 | |
| Stabilizing Solution (tank solution and replenisher being the same) | | |
| Formalin (37 wt %) | | 0.1 g |
| Formalin-Sulfurous Acid Adduct | | 0.7 g |
| 5-Chloro-2-methyl-4-isothiazoline-3-one | | 0.02 g |
| 2-Methyl-4-isothiazoline-3-one | | 0.01 g |
| Copper Sulfate | | 0.005 g |
| Water to make | 1000 ml | |

-continued

| | Tank Solution | Replenisher |
|---|---|---|
| pH (25° C.) | 4.0 | |

For each of the samples thus obtained, the fading test was conducted in the same manner as that of Example 4. As a result, the samples of the present invention were significantly high in light fastness as compared with Example 4. This reveals that this effect does not depend on the development processing methods.

EXAMPLE 6

Sample A was prepared in the same manner as in sample 101 described in Example 1 of JP-A-2-854, except that coupler C-1 contained in the third and fourth layers and coupler C-6 contained in the fifth layer were replaced with equimolar amounts of coupler IC-16 of the present invention, that magenta coupler C-3 contained in the seventh, eighth and ninth layers was replaced with equimolar amounts of coupler IM-14 of the present invention, and that coupler C-5 contained in the twelfth layer and coupler C-7 contained in the thirteenth layer were replaced with coupler IY-2 of the present invention. Further, samples B and C were prepared in the same manner as in sample 101, except that compound IA-14 or IA-34 of the present invention was added to the third, forth, fifth, seventh, eighth, ninth, twelfth and thirteenth layers in an amount of 25 mol. % based on the total amount of couplers contained in each layer.

In addition, sample D was prepared in the same manner as in example 101, except that the high boiling point organic solvents contained in the third, forth, fifth, seventh, eighth, ninth, tenth, eleventh, twelfth and thirteenth layers were replaced with the same weight of compound IO-7 of the present invention. These samples A, B, C and D and sample 101 were subjected to exposure and development processing in the same manner as in Example 1 described in JP-A-2-854, and then, the fading test was conducted in the same manner as in Examples of the present invention. As a result, the samples of the present invention exhibited the excellent effect of preventing fading, and the photographic characteristics thereof are also satisfactory.

This reveals that the compounds of the present invention exhibit the excellent effects without depending on the light-sensitive materials.

EXAMPLE 7

For the color photographic material described in Example 2 of JP-A-1-158431, sample E was prepared in the same manner as in the color photographic material described in Example 2 of JP-A-1-158431, except that the cyan couplers (ExC-1 and ExC-2) contained in the third and fourth layers were replaced with equimolar amounts of coupler IC-16 of the present invention, that the magenta couplers (ExM-1 and ExM-2) contained in the sixth and seventh layers were replaced with equimolar amounts of coupler IM-14 of the present invention, and that the yellow coupler (ExY-1) contained in the eleventh and twelfth layers was replaced with equimolar amounts of coupler IY-2 of the present invention. Further, samples F and G were prepared in the same manner as in the color photographic material described in Example 2 of JP-A-1-158431, except that compound IA-14 or IA-34 of the present invention was added to the third, fourth, sixth, seventh, eleventh and twelfth layers in an amount of 100 mol. % based on the amount of couplers contained in each layer. In addition, sample H was prepared in the same manner as in the color photographic material described in Example 2 of JP-A-1-158431, except that the solvents for couplers contained in the third, fourth, sixth, seventh, eleventh and twelfth layers and the solvents for color mixing inhibitors contained in the eighth and ninth layers were replaced with the same amounts of compound IO-7 of the present invention. Samples E, F, G and H and the color photographic material described in Example 2 of JP-A-1-158431 were subjected to exposure and development processing in the same manner as in Example 2 of JP-A-1-158431, and then, the fading test was conducted in the same manner as in Examples of the present invention. As a result, the samples of the present invention exhibited the excellent effect of preventing fading, and the photographic characteristics thereof are also satisfactory.

This reveals that the compounds of the present invention exhibit the excellent effects without depending on the light-sensitive materials.

As is apparent from the results of Examples, the compounds represented by formula (I) of the present invention do not adversely affect the photographic characteristics (particularly produce no fog) and remarkably improve the light fastness of color images obtained from couplers, in any cases where they are incorporated in coupler molecules, used as additives and used as high boiling point organic solvents.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having a photographic layer thereto, said layer containing at least one compound represented by formula (I-2):

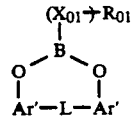

(I-2)

wherein Ar' represents a divalent aromatic group; L represents a mere bond or a divalent organic group; and $R_{01}$ represents a hydrogen atom, an aliphatic group, an aromatic group or a heterocyclic group; $X_{01}$ represents a mere bond, —O—, —S— or

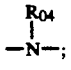

and $R_{04}$ has the same meaning as $R_{01}$.

2. A silver halide color photographic material as claimed in claim 1, wherein the compound represented by formula (I-2) is a color image stabilizer.

3. A silver halide color photographic material as claimed in claim 1, wherein the photographic material further contains at least one coupler and the compound represented by formula (I-2) is used as an antifading agent or a high boiling organic solvent in an amount of 1 to 400% by weight based on the weight of the at least one coupler.

4. The silver halide color photographic material in claim 1 wherein $R_{01}$ is a coupler residue group and where the compound represented by formula I-2) is present in an amount of 01 to 1.0 mol per mol of the silver halide.

5. The silver halide color photographic material as claimed in claim 1 wherein the compound represented by formula (I-2) is a dispersing agent for a hydrophobic additive.

6. A silver halide color photographic material as claimed in claim 1, wherein $X_{01}$is —O—, —S— or $$-\overset{\overset{R_{04}}{|}}{N}-.$$

7. A silver halide color photographic material as claimed in claim 1, wherein $X_{01}$ is —O—.

8. A silver halide color photographic material as claimed in claim 1, wherein the aliphatic group represented by $R_{01}$ represents alkyl groups, alkenyl groups, alkynyl groups, cycloalkyl groups, cycloalkenyl groups, cycloalkynyl groups or aralkyl groups.

9. A silver halide color photographic material as claimed in claim 1, wherein the aromatic group represented by $R_{01}$ represents carboxylic aromatic groups which may be monocyclic or condensed-cyclic and further substituted.

10. A silver halide color photographic material as claimed in claim 1, wherein the heterocyclic group represented by $R_{01}$ represents groups of 3- to 10- membered rings formed by oxygen atoms, unitroen atoms and/or sulfur atoms, which may be saturated rings or unsaturated rings and further substituted.

11. A silver halide color photographic material as claimed in claim 1, wherein Ar' is a phenylene group.

12. A silver halide color photographic material as claimed in claim 1, wherein L is an alkylene group substituted by an alkyl group.

13. The silver halide color photographic material as in claim 1 wherein Ar' is a substituted arylene group having a 6 to 20 carbon atoms.

14. The silver halide color photographic material as in claim 1 wherein the divalent organic groups are alkylene groups having 1 to 10 carbon atoms, phenylene groups, —O—, —S— or combinations thereof.

* * * * *